US007691031B2

(12) United States Patent
Toyama et al.

(10) Patent No.: US 7,691,031 B2
(45) Date of Patent: Apr. 6, 2010

(54) TRAINING APPARATUS

(75) Inventors: Motoki Toyama, Tokyo (JP); Amika Harada, Tokyo (JP); Takeshi Tsuji, Tokyo (JP); Hirofumi Nagao, Tokyo (JP); Naoyuki Wakiyama, Tokyo (JP)

(73) Assignee: Konami Sports Life Corporation, Tokyo (JP)

( * ) Notice: Subject to any disclaimer, the term of this patent is extended or adjusted under 35 U.S.C. 154(b) by 887 days.

(21) Appl. No.: 11/456,089

(22) Filed: Jul. 7, 2006

(65) Prior Publication Data

US 2006/0234832 A1 Oct. 19, 2006

Related U.S. Application Data

(63) Continuation of application No. PCT/JP2005/000360, filed on Jan. 14, 2005.

(30) Foreign Application Priority Data

Jan. 16, 2004 (JP) ..... 2004-008586

(51) Int. Cl.
*A63B 71/00* (2006.01)

(52) U.S. Cl. ..... 482/8; 482/1; 482/9; 482/900

(58) Field of Classification Search ..... 482/1–9, 482/900–902, 51, 52, 92; 434/247; 600/587
See application file for complete search history.

(56) References Cited

U.S. PATENT DOCUMENTS 4,586,495 A * 5/1986 Petrofsky ..... 602/2
4,828,257 A * 5/1989 Dyer et al. ..... 482/5
4,842,274 A 6/1989 Oosthuizen et al.
4,941,652 A * 7/1990 Nagano et al. ..... 482/73
5,078,152 A * 1/1992 Bond et al. ..... 600/587
5,308,300 A * 5/1994 Chino et al. ..... 482/52
5,738,611 A * 4/1998 Ehrenfried et al. ..... 482/6
5,738,612 A * 4/1998 Tsuda ..... 482/8
5,827,154 A 10/1998 Gill
6,443,873 B2 * 9/2002 Suzuki ..... 482/8
6,450,922 B1 * 9/2002 Henderson et al. ..... 482/8
2001/0036883 A1 * 11/2001 Suzuki ..... 482/8
2005/0209049 A1 * 9/2005 Shields ..... 482/8

FOREIGN PATENT DOCUMENTS

JP 61-22609 Y2 7/1986
JP 8-33736 A 2/1996
JP 2577569 B2 11/1996
JP 2858852 B2 12/1998

* cited by examiner

*Primary Examiner*—Glenn Richman
(74) *Attorney, Agent, or Firm*—Global IP Counselors, LLP

(57) ABSTRACT

A training apparatus is disclosed which allows a trainee to attain a sense of accomplishment by continuing an exercise until a target is reached, without undue strain. A torque motor applies a load to a handle bar, which is driven by the exercise of a trainee. If the movement of the trainee who moves the handle bar is about to stop, then the load is gradually reduced. If the handle bar once again begins to move due to a load reduction, then it is inferred that the trainee has resumed the exercise, and the load at that time is maintained until, for example, the direction of motion of the handle bar changes. By gradually reducing the load at the fatigue limit of the trainee, it is possible to promote the resumption and the continuance of the exercise.

16 Claims, 14 Drawing Sheets

TRAINING APPARATUS

CROSS-REFERENCE TO RELATED APPLICATIONS

This application is a continuation of PCT Patent Application No. PCT/JP2005/000360 filed on Jan. 14, 2005, which claims priority to Japan Patent Application No. 2004-008586 filed on Jan. 16, 2004. The entire disclosures of PCT Patent Application No. PCT/JP2005/000360 and Japan Patent Application No. 2004-008586 are hereby incorporated herein by reference.

BACKGROUND OF THE INVENTION

1. Field of the Invention

The present invention relates to a training machine that is used by an individual to exercise in order to improve physical strength.

2. Background Information

A variety of training machines have been proposed in the past that enable an individual to exercise with an appropriate load. For example, Japanese Patent No. 2858852 proposes a training machine control apparatus that comprises a variable load applying apparatus for applying a load to a trainee. This control apparatus detects the amount of exercise performed by the trainee, and compares the detected amount of exercise with a desired overfatigue discrimination reference value. If a state wherein the detected exercise amount is less than the reference value continues for a prescribed time or longer, then the mode will switch to a cool down exercise mode, which gradually decreases the amount of the load of the load apparatus. Japanese Patent No. 2858852 discloses that, if the trainee becomes fatigued, then he or she can smoothly transition to a cool down exercise without overexerting his or herself, and the training can thereby be safely interrupted.

In addition, Japanese Examined Utility Model Application No. S61-22609 recites a physical strength training apparatus that programmatically controls the load by using a torque motor as the load. This apparatus detects the position of a lever that is operated by a trainee as well as the load acting upon the lever, and controls the output of the torque motor. Below are examples of output control:

(a) The output of the torque motor is controlled so that the position of the lever is always fixed.

(b) The output of the torque motor is always fixed.

(c) The output of the torque motor is controlled in accordance with the position of the lever.

(d) The time and the position of the lever are associated, and the torque output is controlled in accordance with the position of the lever, i.e., the time.

Thus, Japanese Examined Utility Model Application No. S61-22609 discloses that, because the load is controlled by the torque motor and not by weight, the load is easily adjusted and it is possible to programmatically control the load to conform to arbitrary characteristics.

When a trainee actually uses a training machine to apply a load and exercise, even if he or she becomes fatigued midway, the load can be slightly decreased and the trainee can subsequently continue the exercise with that load. However, the training machine control apparatus recited in Japanese Patent No. 2858852 will enter the cool down exercise mode once the trainee becomes fatigued. Consequently, the load steadily decreases and the exercise will end, even if the trainee still has the willpower and the physical strength to continue the exercise.

The physical strength training apparatus recited in Japanese Examined Utility Model Application No. S61-22609 determines the output of the torque motor based on the position of the lever and the load acting thereupon, and there is consequently a risk that the output of the torque motor will stay the same regardless of whether the trainee is fatigued.

In other words, a training machine has yet to be proposed wherein, instead of stopping an exercise if the trainee becomes fatigued, the trainee can exercise without overexertion while the machine provides support so that the trainee can accomplish the target exercise.

In view of the above, it will be apparent to those skilled in the art from this disclosure that there exists a need for an improved training machine that supports a trainee so that he or she can attain a target value of an exercise, even if he or she becomes fatigued. This invention addresses this need in the art as well as other needs, which will become apparent to those skilled in the art from this disclosure.

SUMMARY OF THE INVENTION

To solve the abovementioned problems, a first aspect of the present invention provides a training apparatus that applies a first load to a moving unit, which is provided for the purpose of exercise, by using an electrical load generator. This apparatus comprises a moving unit monitoring unit that monitors the movement of said moving unit when said moving unit is moving; and a load adjusting unit that changes the load from the first load to a second load if a prescribed state is detected in the movement of the moving unit by the moving unit monitoring unit.

If the training apparatus is, for example, a chest press wherein the trainee raises and lowers a barbell in a supine state, then the barbell (also referred to as a handle bar below)) that the trainee grasps and then raises and lowers corresponds to the moving unit. Instead of weights, the load is applied to the handle bar by a servomotor, a stepping motor, a torque motor, a solenoid brake, and the like.

If the movement of the handle bar is too fast while the trainee is lifting the handle bar, then it is inferred that the load is too light. In this case, the load is gradually increased until the handle bar's state of motion falls within the prescribed range. If the handle bar's state of motion enters the prescribed range, then the load at that time is maintained until, for example, the handle bar is fully raised. Subsequently, the value of the increased load may be maintained as is, or may be returned to the original load at a prescribed timing.

In addition, for example, the moving unit monitoring unit may monitor only the time for the handle bar to travel from a start position to a prescribed arrival point. If the speed during the time period until the handle bar reaches the arrival point is too fast, then the travel time will fall below a prescribed value. In this case, the load is gradually increased so that the travel time will enter a fixed range.

The above example increases the load during the training; however, conversely, if the load is too great for the trainee, then the load can be reduced.

Because the moving unit monitoring unit continuously monitors the state of motion of the moving unit, the training apparatus according to the present invention can support the continuance of an appropriate exercise by changing the load in response to the trainee's level of fatigue and reserve of physical strength during training. Here, the trigger for changing the load is the state of motion of the moving unit, which was discussed above, and is not merely reducing or increasing the load when the state of motion falls below or rises above a given fixed value, but also includes changing the load in accordance with the training state. For example, even if the movement of the moving unit stops instantaneously (a state wherein the trainee cannot lift the handle bar), instead of reducing the load immediately, a change in the load will be determined based on one or more conditions, such as whether that stoppage continues for a prescribed period of time.

The second aspect of the present invention provides a training apparatus as recited in the first aspect, wherein the load adjusting unit sets the second load to be lower than the first load.

Let us take as an example a case in which the training apparatus is a chest press, wherein the trainee, for example, raises and lowers the handle bar in a supine state. If the handle bar stops midway while the trainee is lifting the handle bar, then it is inferred that the exercise has stopped because the load is too heavy. In this case, the load is gradually reduced until the trainee once again begins to push the handle bar up. If the handle bar once again begins to rise, the load at that time is maintained until, for example, the handle bar is fully raised. The value of the reduced load may be maintained as is, or may be returned to the original load at a prescribed timing.

As used herein, the term "resting state" refers to a state wherein the moving unit, e.g., the handle bar, stops at a prescribed position and does not move during a prescribed operation time, and includes not just the case wherein the handle bar completely stops during training, but also the case wherein the speed of the handle bar is less than a prescribed value. The prescribed operation time is the training time within which the handle bar should move through one rep.

Here, the resting state also includes a case wherein the moving unit monitoring unit monitors only the time in which the handle bar travels from the start position to a prescribed arrival point. This is a case wherein, for example, the handle bar is monitored from the start position to the upper end reference position (discussed later) to see whether it arrives within ten seconds. Even if the speed temporarily drops during the time period in which the handle bar reaches the arrival point, it is inferred that the handle bar did not achieve a resting state if the speed picks up midway and the handle bar arrives at the arrival point within the prescribed time. Conversely, it is inferred that the handle bar did achieve at a resting state if it does not arrive within the prescribed time period, in which case the arrival of the moving unit at the arrival point is supported by reducing the load. In other words, if the handle bar does not arrive at the upper end reference position even though ten seconds have passed, then the load is reduced. In this case, the resting state during the prescribed operation time is the case wherein the time needed for the handle bar to travel from the start position and arrive at the arrival point exceeds the prescribed time (e.g., ten seconds). The prescribed operation time is the training time in which the handle bar should move through one rep from the start position to the arrival point and back to the start position.

When the trainee can no longer continue the exercise due to fatigue, the training apparatus according to the present invention supports the resumption of the exercise by gradually reducing the load. Consequently, the trainee can tell that the load was slightly reduced midway, but can feel a sense of accomplishment in that he or she could perform the exercise for the target count.

The third aspect of the present invention provides a training apparatus as recited in the first or second aspects, further comprising a setting unit that sets at least one reference position in the area in which the moving unit moves. If the moving unit travels beyond the reference position along a preset direction of motion of the moving unit with respect to the reference position, then the present apparatus will stop the moving unit or set the load applied to the exercise to zero.

Let us once again take the chest press as an example. Prior to starting the exercise, the training apparatus measures reference positions that prescribe a range of motion of the handle bar that the trainee moves. As one example, a process is provided wherein, prior to starting the exercise, the trainee temporarily moves the handle bar, on his or her own accord and within a range that does not cause undue strain, from a lower end position to an upper end position, and those positions detected at that time are set as the reference positions. Accordingly, two reference positions, i.e., the lower end and the upper end, are set in this case. However, only the lower end reference position, for example, may be set. Thus, the range of motion is a space within the movement area, which is the maximum space within which the handle bar can move, and is prescribed by reference positions. The following explanation is based principally on the range of motion.

The range of motion differs by various factors, such as the physical constitution, gender, and training experience of the trainee, the type of exercise, and the like.

By adjusting the weight of the handle bar substantially to zero outside the range of motion, the training apparatus according to the present invention assures the safety of the trainee if the handle bar is positioned outside the range of motion. Namely, there are cases in the conventional art where an extremely dangerous situation could arise if someone working out alone were lifting heavy weights and his or her physical strength suddenly gave out; however, according to the present invention, even if the handle bar temporarily drops, the load is set substantially to zero if the handle bar moves outside the range of motion, or the handle bar is stopped, which reliably ensures the safety of the trainee. On the other hand, when the trainee wishes to stop the exercise, he or she can do so at any time simply by moving the handle bar outside the range of motion; therefore, if some kind of urgent matter arises while the trainee is exercising, then the trainee can easily deal with it immediately, which provides the training apparatus with excellent operability. In addition, by providing the abovementioned functions, the trainee can train in a psychologically secure state.

In addition, the setting of the load to zero when the handle bar deviates from the range of motion can be performed for both the upper and lower ends of the range of motion. However, if it is determined that there will be few cases wherein the handle bar will be pushed upward beyond the range of motion, then the load may be set to zero for just the lower end (i.e., the case wherein the reference position is set for only the lower end). Furthermore, in the description above, the state wherein the load on the exercise is zero is a state wherein the load in an amount equal to the weight of the handle bar is applied in the upward direction to the handle bar by a motor. Accordingly, the handle bar thereby appears to be stopped at the same position, e.g., the handle bar is in a state wherein it moves easily either upward or downward just by touching it lightly by hand.

If a solenoid brake is used as the load generator, then it is possible only to apply a load so that the movement of the moving unit is stopped and it is not possible to drive the moving unit in the reverse direction as described above; consequently, the moving unit may be stopped in a fixed state so that, at the point in time when the moving unit goes beyond the reference position, a load greater than the abovementioned load is not applied. Furthermore, a method is also conceivable wherein the fixed state is released after a prescribed time so that the training can be continued.

The fourth aspect of the present invention provides a training apparatus as recited in the first or second aspects, wherein the moving unit is movable in a first direction, and a second direction which is the reverse direction of the first direction. In the present apparatus, the moving unit monitoring unit further monitors the direction of motion of the moving unit. In addition, if the load adjusting unit changes the load from the first load to the second load when the moving unit is moving in one direction, then the load adjusting unit will set the load to a third load when the moving unit monitoring unit detects that the direction of motion of the moving unit has switched to another direction.

If the direction of motion of the moving unit switches after changing the load from the first load to the second load, then the load is adjusted to the third load. Once again taking the chest press as an example, if the load is changed from the first load to the second load when the handle bar is being raised, then the load is set to the third load when the direction of motion of the handle bar switches from the upward to the downward direction. In addition, for example, if the exercise is one wherein the handle bar is pulled downward, such as supine rowing (discussed below), then, if the load is changed from the first load to the second load when the handle bar is being lowered, the load will be changed to the third load when the direction of the handle bar shifts from downward to upward. If the second load is less than the first load (first load>second load) and the third load is set to a weight that is less than the first load and greater than or equal to the second load (first load≧third load≧second load), then the continuation of the exercise can be supported by reducing the load only when the trainee needs to. In addition, it is preferable that the strain on the trainee's muscles is not too great.

Furthermore, in the case of a chest press, which requires a large load when the handle bar is being pushed upward, the load reducing function according to the present invention should function when the exercise is at the point where the trainee is about to push the handle bar upward; in contrast to this exercise, in the case of a training apparatus that requires a large load when the handle bar is pulled downward, the load reducing function should function when the exercise is at the point where the trainee is about to pull the handle bar downward.

In addition, the first direction and the second direction herein are not only rectilinear directions of motion, but should also indicate mutually reverse directions, and also include curvilinear directions of motion, such as those that describe an arc. In the case of the abovementioned chest press, the operation of the handle bar is principally rectilinear in the upward and downward directions; however, the third aspect of the present application can also be adapted to a training apparatus wherein the trainee sits in a chair and moves his or her calves.

The fifth aspect of the present invention provides a training apparatus as recited in the fourth aspect, wherein the load adjusting unit maintains the second load until the moving unit monitoring unit detects that the direction of motion of the moving unit has been switched.

For example, in the chest press of the fourth aspect, if the load is changed from the first load to the second load when the handle bar is being raised, then the second load is maintained until the direction of motion of the handle bar switches from the upward to the downward direction, and then the load is set to the third load after the switch. In addition, let us consider an example of an exercise wherein the handle bar is lowered, as in supine rowing. If the load is changed from the first load to the second load when the handle bar is being lowered, then the second load is maintained until the movement of the handle bar shifts from downward to upward, and then the load is set to the third load after the switch. In this case, by maintaining the value of the post-reduction load until the handle bar is fully raised or fully lowered, it is possible to support the resumption of the exercise.

The sixth aspect of the present invention provides a training apparatus as recited in the fifth aspect, wherein when the moving unit monitoring unit detects that the direction of motion of the moving unit has switched, the load adjusting unit adjusts the third load to a range that is less than the first load and greater than or equal to the second load.

Let us once again take the previously discussed chest press as an example. When the trainee resumes exercise due to the reduction of the load and then lifts the handle bar to the highest point and lowers it, the load may be increased. This is because the load tolerance of the trainee is normally higher when lowering the handle bar than when raising it. However, because the strain on the muscles is excessive if the differential is too large between the post-reduction load and the load to which the load returns therefrom, the present invention provides a limit to the load differential, which more reliably ensures the safety of the exercise performed by the trainee. Specifically, it is possible to avoid applying an unreasonable load to the muscles by setting the post-return third load W3 so that it does not exceed the pre-reduction first load W1 (W3≦W1), and by setting the upper limit to 130% to 140% of the post-reduction second load W2 (W2≦W3≦W2×1.3 to 1.4).

The seventh aspect of the present invention provides a training apparatus as recited in the first aspect, wherein the moving unit is movable in a first direction, and a second direction which is the reverse of the first direction. In the present apparatus, the moving unit monitoring unit further monitors the direction of motion of the moving unit. In addition, the load adjusting unit reduces the load from the first load to the second load only when the moving unit is moving along the first direction.

Once again taking the chest press as an example, the load should be adjusted by reducing the load from the first load to the second load only if the handle bar is moving in the upward direction (herein, the first direction), and the third load should be set the same value as the first load when the handle bar is moving in the downward direction (herein, the second direction). This is because the load tolerance of the trainee is higher when lowering the handle bar than when raising it. In other words, because the trainee who is lowering the handle bar is supported by applying a load only when the handle bar is being lowered, it is easier for the trainee who is lowering the handle bar to physically bear the load compared with the case of lifting the handle bar upward. Accordingly, there is little need to reduce the load when lowering the handle bar. Thus, making the direction of the exercise that is subject to load reduction only the single direction that is thought to require load reduction, contributes to the simplification of the design of the apparatus.

Furthermore, in the case of a chest press, which requires a large load when the handle bar is being pushed upward, the load reducing function according to the present invention should function when the exercise is at the point where the trainee is about to push the handle bar upward. In contrast to this exercise, in the case of a training apparatus that requires a large load when the handle bar is pulled downward, the load reducing function should function when the exercise is at the point where the trainee is about to pull the handle bar downward.

In addition, the first direction and the second direction herein are not only rectilinear directions of motion, but should also indicate mutually reverse directions, and also include curvilinear directions of motion, such as those that describe an arc. In the case of the abovementioned chest press, the operation of the handle bar is principally rectilinear in the upward and downward directions. However, the third aspect of the present application can also be adapted to a training apparatus wherein the trainee sits in a chair and moves his or her calves.

The eighth aspect of the present invention is a training apparatus as recited in the second aspect, wherein the moving unit monitoring unit monitors the speed of movement of the moving unit and determines whether the speed has fallen below a prescribed value for a prescribed period of time. In the present apparatus, if the speed has fallen below a prescribed value for a prescribed period of time, then the load adjusting unit will reduce the load from the first load to the second load.

As one example, the travel speed of the moving unit is monitored as the state of motion. Because the travel speed is detected by monitoring the rotational speed of the motor, the state of motion of the moving unit can be easily and accurately ascertained.

The ninth aspect of the present invention provides a training apparatus as recited in the first aspects, further comprising a display unit, and an indicating unit that outputs to the display unit an indication related to the timing at which the moving unit is being moved.

Let us once again take the example of a chest press. The motion timing is, for example, the tempo at which the trainee moves the handle bar. Furthermore, speakers may be provided, and voice, music and the like suited to the tempo may be outputted to the speakers. Because the training apparatus specifies the tempo instead of a coach, the trainee exerts effort so as to move the handle bar at an appropriate speed.

Furthermore, it is preferable to modify the indicated motion timing in accordance with personal data, such as age, gender, muscle strength, as well as the weight of the load and the like. In addition, if the trainee stops exercising midway, the indicated motion timing may not be changed regardless of the actual movement of the handle bar, or the indicated motion timing may be changed in accordance with the actual movement of the handle bar.

The tenth aspect of the present invention provides a training apparatus as recited in the ninth aspect, wherein the indicating unit outputs an indication related to the motion timing by graphically displaying on the display unit an index of the motion timing at which the moving unit is moved.

Let us once again take the chest press as an example. Displayed on the display unit are, for example, a window, a simulation bar that moves up and down inside that window, and a number that indicates the rhythm. The height of the window (height in the direction perpendicular to the floor) corresponds analogically to the range of motion of the moving unit. The combination of the rising and falling of the simulation bar and the number that indicates the rhythm specifies the tempo at which the trainee moves the handle bar. By displaying the index of the motion timing as an image as described above, the trainee can intuitively know the target timing for the exercise. Furthermore, the index herein is graphically displayed so that the trainee, who visually perceives the speed at which to vary the moving unit as well as the various timings, such as the start, the movement, and the stopping of the moving unit, can easily reflect that information in the exercise. In the examples above, the index is a combination of the simulation bar and a number, but is not limited thereto and may be just the simulation bar or, instead of the simulation bar, one wherein a point of light moves across the arc of a pie chart. In addition, background music suited to the movement and timing of the abovementioned index may be played.

The eleventh aspect of the present invention provides a training apparatus as recited in the ninth or tenth aspects, wherein the moving unit monitoring unit monitors the speed of movement of the moving unit. In the present apparatus, the indicating unit changes the indicated timing in response to changes in the speed of the moving unit.

In a chest press, for example, if the trainee slows down the speed at which he or she pushes the handle bar upward or stops the exercise, then the specified tempo can be slowed, stopped, and the like. If the trainee can keep up with the slowed specified tempo, then it is possible for the trainee to feel a sense of satisfaction in that he or she was able to achieve the target count without changing the load.

There is a case wherein it is more preferable to combine the reduction of the load with a change in the specified tempo. For example, if the speed at which the handle bar is pushed up slows down, then the specified tempo can be slowed while reducing the load. If the fatigue level of the trainee is high, then it is easier to resume exercise if the specified tempo is slowed in addition to reducing the load, which is preferable.

The twelfth aspect of the present invention provides a training apparatus as recited in any one of the ninth through eleventh aspects, wherein if the load adjusting unit reduces the load from the first load to the second load when the moving unit is stopped, and then the moving unit starts to move again, the indicating unit will indicate the movement of the moving unit in accordance with the reduced load.

In a chest press, for example, if the exercise resumes due to the reduction of the load, then the specified tempo may be increased. The amount of exercise performed, which is reduced by the amount that the load was reduced, can be supplemented by increasing the tempo. The trainee can thereby attain a sense of accomplishment to a certain extent by increasing the speed of the exercise, even though the load was reduced. In addition to personal data, such as age, gender, and muscle strength, as well as the weight of the load, the tempo after reducing the load is preferably determined based on the pre-reduction load, the differential in the loads before and after the reduction, and the like.

Furthermore, in the eleventh and twelfth aspects, if a method is adopted that decreases the speed or slows the tempo in response to the load reduction, then it is preferable not to play background music. This is because, originally, background music is synchronized to the abovementioned tempo in order to set the rhythm of the exercise. Therefore, if the tempo is slowed, then that music will also play slowly and the trainee will perceive his or her own state of fatigue. In addition, there is a risk that this will end up reducing, instead of enhancing, the sense of accomplishment of the exercise.

The thirteenth aspect of the present invention is a training apparatus as recited in the third aspect, wherein the training apparatus further comprises a seat unit that is configured to switch between a first position and a second position. In the present apparatus, the setting unit sets differing reference positions for the first position and the second position of the seat unit.

A trainee can use a training apparatus that has one handle bar to perform various types of exercises. For example, the shoulder press and the pull-down are performed when the seat is in the sitting position (the first position). In addition, the chest press and supine rowing are performed when the seat is in the supine position (the second position). If the seat is switched between the sitting position and the supine position while the trainee is exercising, then the handle bar should first be moved to the upper or the lower end of the range of motion and then the seat position should be switched. Furthermore, of the exercises discussed above, the shoulder press and the chest press require push-up strength in order to raise the handle bar. With these exercises, when the handle bar, which is moved upward and downward, is descending, the trainee gradually lowers the descending handle bar while exerting effort to support it. Accordingly, in the case of these exercises, the load applied to the trainee is much greater when lifting the handle bar than when lowering it. Pull-downs and supine rowing are exercises that require pull-down strength in order to lower the handle bar. With these exercises, when the handle bar, which is moved upward and downward, rises, the trainee gradually returns the handle bar, which is inclined to rise upward of its own accord, upward while exerting effort to pull the handle bar back toward him or herself. Accordingly, in the case of these exercises, the load applied to the trainee is larger when lowering the handle bar than when raising it.

According to the present invention, a trainee can achieve a training target because the training load is reduced as needed. Accordingly, the trainee is filled with a sense of fulfillment and his or her motivation can be maintained.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Overview of the Invention

In a training apparatus according to the present invention, a motor applies a load to a handle bar (corresponding to a moving unit) that is driven by the movement of a trainee. When the movement of the trainee who is moving the handle bar stops or is nearly about to stop, the load is gradually reduced. If the handle bar once again begins to move due to the reduction of the load, then it is inferred that the trainee has resumed exercise, and the load at that time is maintained, at least temporarily.

By gradually reducing the load when the trainee reaches his or her fatigue limit, it is possible to promote the resumption and continuation of the exercise. Accordingly, the trainee can attain a sense of accomplishment in that he or she was able to achieve the amount of exercise targeted when initially starting the exercise.

First Embodiment

Hardware Configuration

1. Overall Configuration

Figure 1:
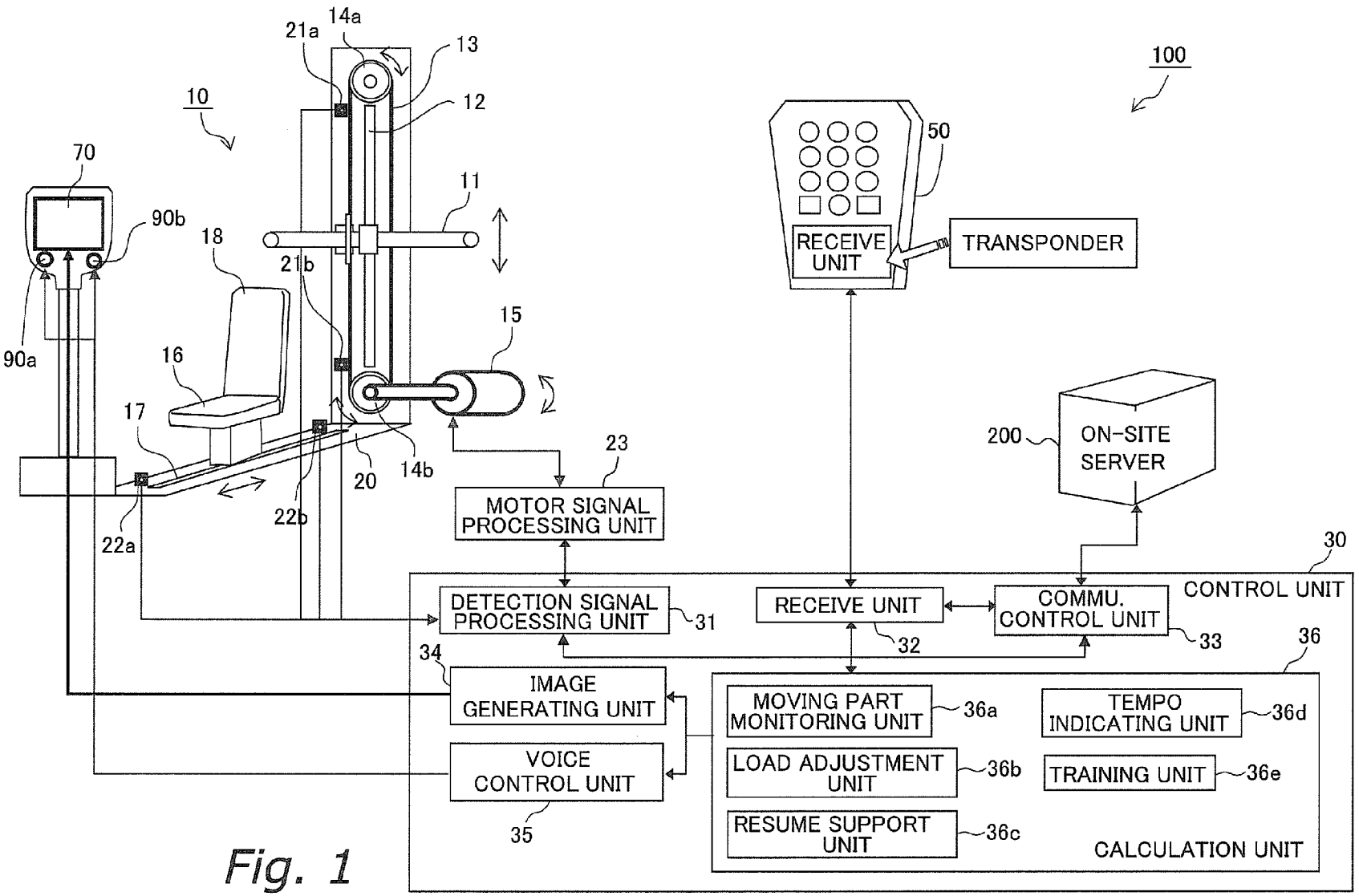
FIG. 1 depicts a training apparatus according to the first embodiment of the present invention.

FIG. 1 is a block diagram of a training apparatus 100 according to the first embodiment of the present invention. The training apparatus 100 is installed, for example, in a facility such as a health club, and is connected to an on-site server 200. The server 200 accumulates the personal data of trainees, and transmits such in response to requests from the training apparatus 100. Furthermore, in the present embodiment, the server 200 is only installed in a facility such as a health club, but an off-site server may be provided that connects on-site servers nationwide or worldwide. Membership data may be accumulated in such an off-site server, and each on-site server may access that data.

The training apparatus 100 comprises a main body 10 (corresponding to a seat unit), a control unit 30, an input unit 50, a monitor 70, and speakers 90*a, b*. The details of the main body 10 and the control unit 30 are discussed below. The control unit 30 is a computer that comprises a CPU, ROM, RAM, a hard disk, and the like. The input unit 50 has a function that receives the input of data, which can be implemented by, for example, a receive unit, such as a transponder, as well as a numeric keypad unit and a card reader. The monitor 70 and the speakers 90 output images and sound, respectively, in accordance with a program stored by the control unit 30.

2. Main Body

The main body 10 will now be more specifically described, referencing one example of the training apparatus 100, which is depicted in FIGS. 2A and 2B and FIGS. 3A and 3B. FIGS. 2A and 2B and FIGS. 3A and 3B depict one example of the training apparatus 100. The training apparatus 100 in this example has a structure wherein the trainee seated on the seat can work the muscles of the back, shoulders and chest by moving a handle bar 11 (corresponding to the moving unit) vertically along a guide rail 12.

The handle bar 11 is attached so that it is capable of sliding along the guide rail 12, which is vertical to the installation surface of the main body 10. In addition, the handle bar 11 is fixed to a belt 13. The belt 13 is looped onto two pulleys 14*a*, 14*b*, which are respectively provided at the upper and lower ends of the guide rail 12. The pulley 14*b* shares a rotary shaft with a torque motor 15, which functions as a load generator. The rotational direction, the rotational speed, the rotational count, and the like of the torque motor 15 are controlled by the control unit 30 via a motor signal processing unit 23. When the trainee vertically moves the handle bar 11, the belt 13 moves and the pulleys 14*a*, 14*b* thereby begin to rotate. At this point, the torque motor 15 applies torque to the pulley 14*b*, which imparts a load to the handle bar 11. Furthermore, a servomotor, a stepping motor, and the like can also be used in place of the torque motor. In addition, in place of the motor, a load may be applied to the handle bar 11 by using a solenoid brake and the like.

Figure 2B:
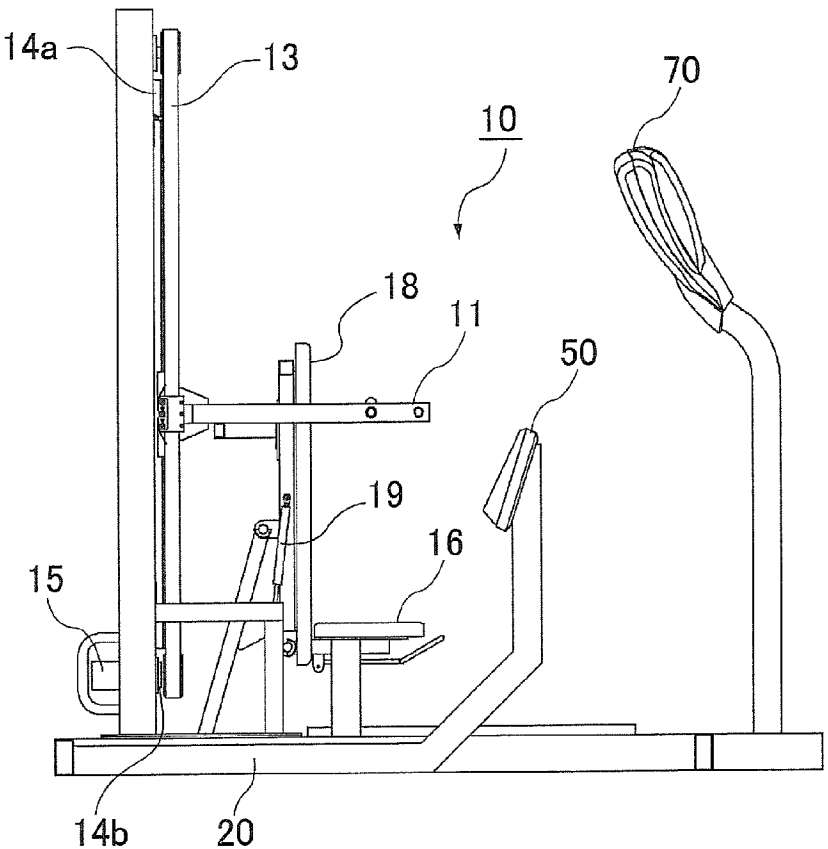
FIGS. 2A and 2B depict one example (a state wherein the seat is upright) of the training apparatus in FIG. 1.
Figure 2A:
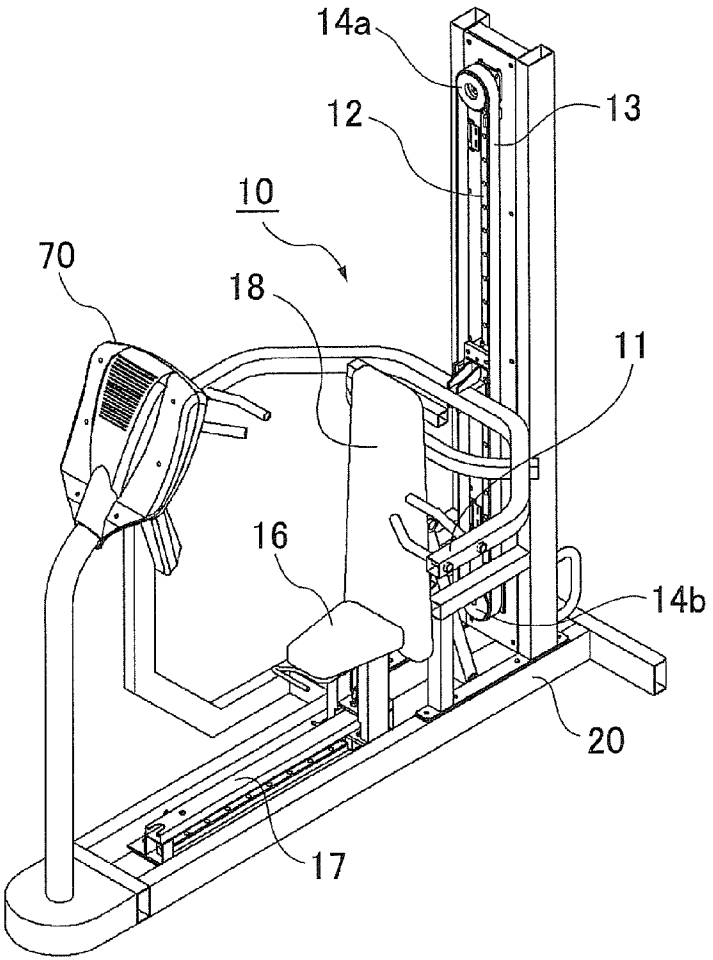
Figure 3B:
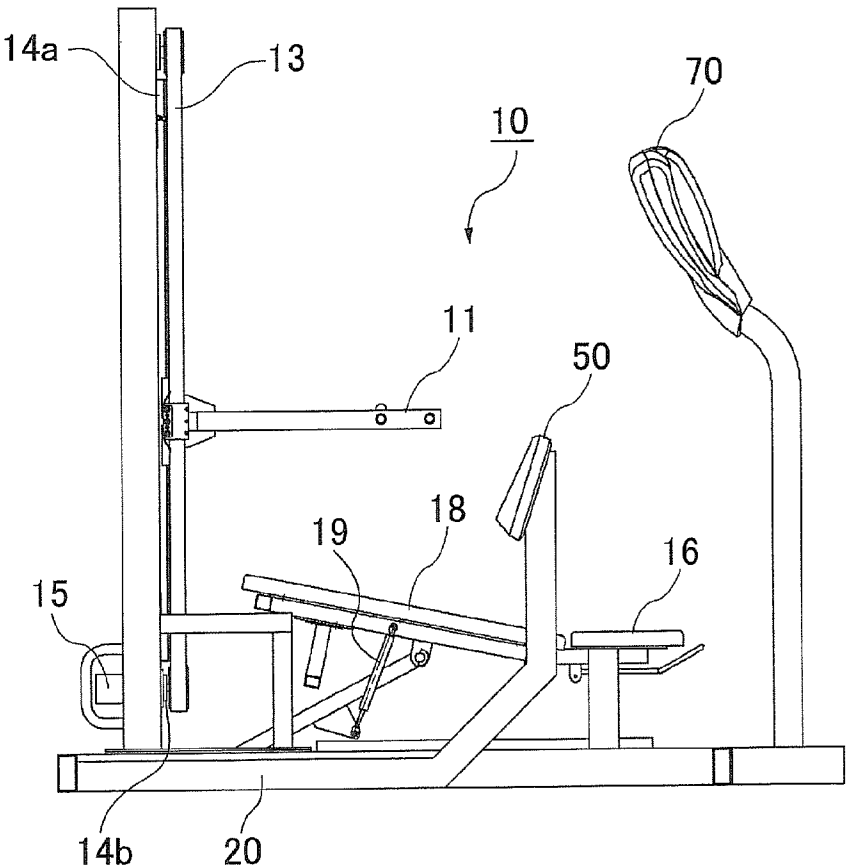
FIGS. 3A and 3B depict one example (a state wherein the seat is lying down) of the training apparatus in FIG. 1.
Figure 3A:
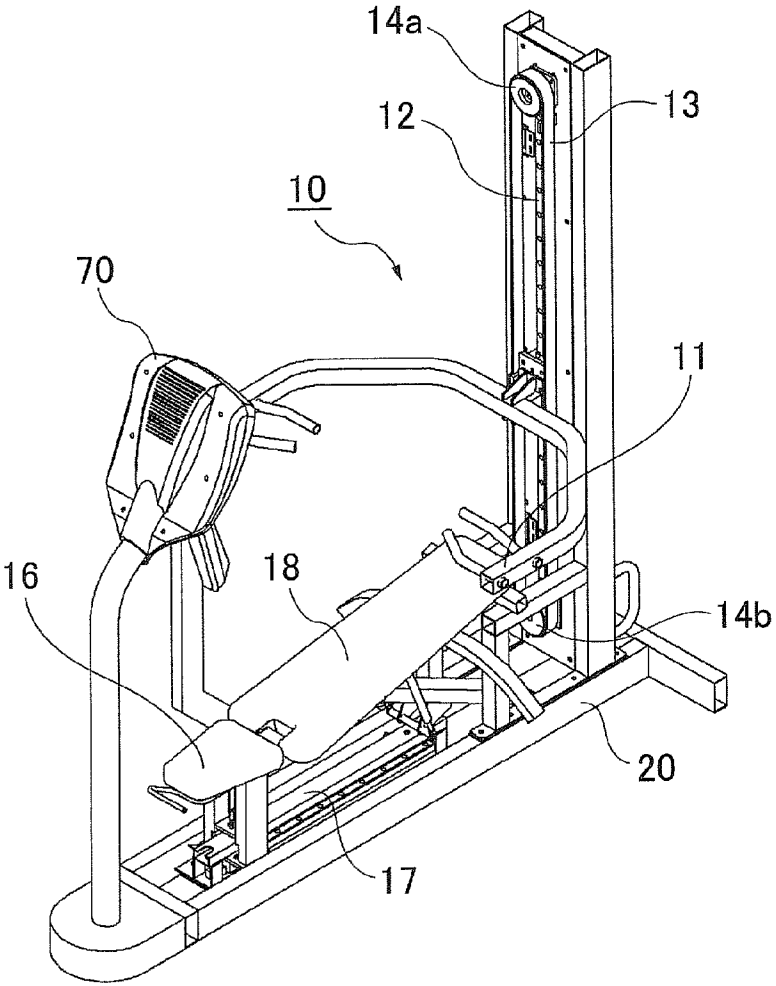

A seat 16 of the main body 10 is capable of sliding along a seat rail 17 parallel to the installation surface of the main body 10. A backrest 18 stands up or lies down depending on the position of the seat 16. FIGS. 2A and 2B and FIGS. 3A and 3B depict the changes in the positions of the seat 16 and the backrest 18. FIGS. 2A and 2B depict a state wherein the seat 16 is at the rearmost position and wherein the backrest 18 is substantially upright with respect to the seat 16 (first position). The exercises that the trainee can perform in the state depicted in FIGS. 2A and 2B are the shoulder press and the pull-down, which are performed in the sitting position. FIG. 3 depicts the state wherein the seat 16 is in the frontmost position and wherein the backrest 18 is substantially flush with the seat 16 (second position). A hydraulic damper 19 is attached to the backrest 18, which facilitates changing the positions of the seat 16 and the backrest 18. The exercises that the trainee can perform in the state depicted in FIGS. 3A and 3B are the chest press and supine rowing, which are performed in the supine position. If switching between the sitting position in FIGS. 2A and 2B and the supine position in FIGS. 3A and 3B while the trainee is exercising, then the seat position should be switched by first setting the handle bar 11 to a no load state by moving it to the upper or lower end of the range of motion, which is discussed later.

Furthermore, of the exercises discussed above, the shoulder press (FIGS. 2A and 2B) and the chest press (FIGS. 3A and 3B) require push-up strength in order to raise the handle bar 11. With these exercises, when the trainee pushes the handle bar 11 up toward the upper end of the range of motion, which is discussed later, and subsequently lowers the handle bar 11, the trainee will gradually lower the handle bar 11 downward while exerting just enough effort to support the handle bar 11. Accordingly, when performing these exercises, the load applied to the trainee is much greater when lifting the handle bar 11 than when lowering it.

Pull-down (FIGS. 2A and 2B) and supine rowing (FIGS. 3A and 3B) are exercises that require pull-down strength in order to lower the handle bar. With these exercises, the trainee pushes the handle bar 11 down toward the lower end of the range of motion, which is discussed later, and then raises the handle bar 11, at which time the trainee gradually returns the handle bar upward while exerting effort to pull the handle bar 11, which is inclined to rise upward of its own accord, back toward him or herself. Accordingly, in the case of these exercises, the load applied to the trainee is larger when lowering the handle bar 11 than when raising it.

The guide rail 12, the belt 13, the pulleys 14*a*, 14*b*, the torque motor 15, and the seat rail 17 are attached to a frame 20, which is L shaped in a side view. In addition, bar switches 21*a, b* and seat switches 22*a, b* are provided to the frame 20. The bar switches 21*a, b* turn on and off when the handle bar 11 comes to the upper limit position and the lower limit position, respectively, and send signals to the control unit 30. The seat switches 22*a, b* turn on and off when the seat 16 comes to the frontmost position and the rearmost position, respectively, and send signals to the control unit 30.

Functional Configuration

The following explains the functions of the training apparatus 100. The training apparatus 100 principally has a training function and an exercise amount adjustment function. These functions are implemented by the control unit 30.

1. Control Unit

The details of the control unit 30 will now be explained, referencing FIG. 1 once again. The control unit 30 has the functions described in (a) through (f) below:

(a) a detection signal processing unit 31 that processes detection signals from the main body 10, the motor signal processing unit 23, the bar switches 21*a, b*, and the seat switches 22*a, b;*

(b) a receive unit 32 that receives input signals from the input unit 50 and passes them to a calculation unit 36;

(c) a communication control unit 33 that sends and receives personal data to and from the server 200;

(d) an image generating unit 34 that generates display data and sends such to the monitor 70;

(e) a voice control unit 35 that generates voice data and sends such to the speakers 90*a, b*; and (f) a calculation unit 36 that controls each unit of the control unit 30 by executing a program stored in semiconductor memory (not shown).

2. Calculation Unit

The calculation unit 36 executes a program in order to implement the: (A) training function; and (B) exercise amount adjustment function. The calculation unit 36 comprises a moving unit monitoring unit 36*a*, a load adjustment unit 36*b*, a resume support unit 36*c*, a tempo indicating unit 36*d*, and a training unit 36*e*, which are used to implement the abovementioned two functions.

(A) Training Function

The training function is implemented by the execution of a training program which is stored in semiconductor memory (not shown), by the training unit 36*e* of the calculation unit 36. The training program receives the input of the personal data of the trainee, measures the maximum physical strength 1 RM (repetition maximum) of the trainee, receives the selection of the modes, processes each mode, measures the seat position, explains the training method, and the like.

Figure 4:
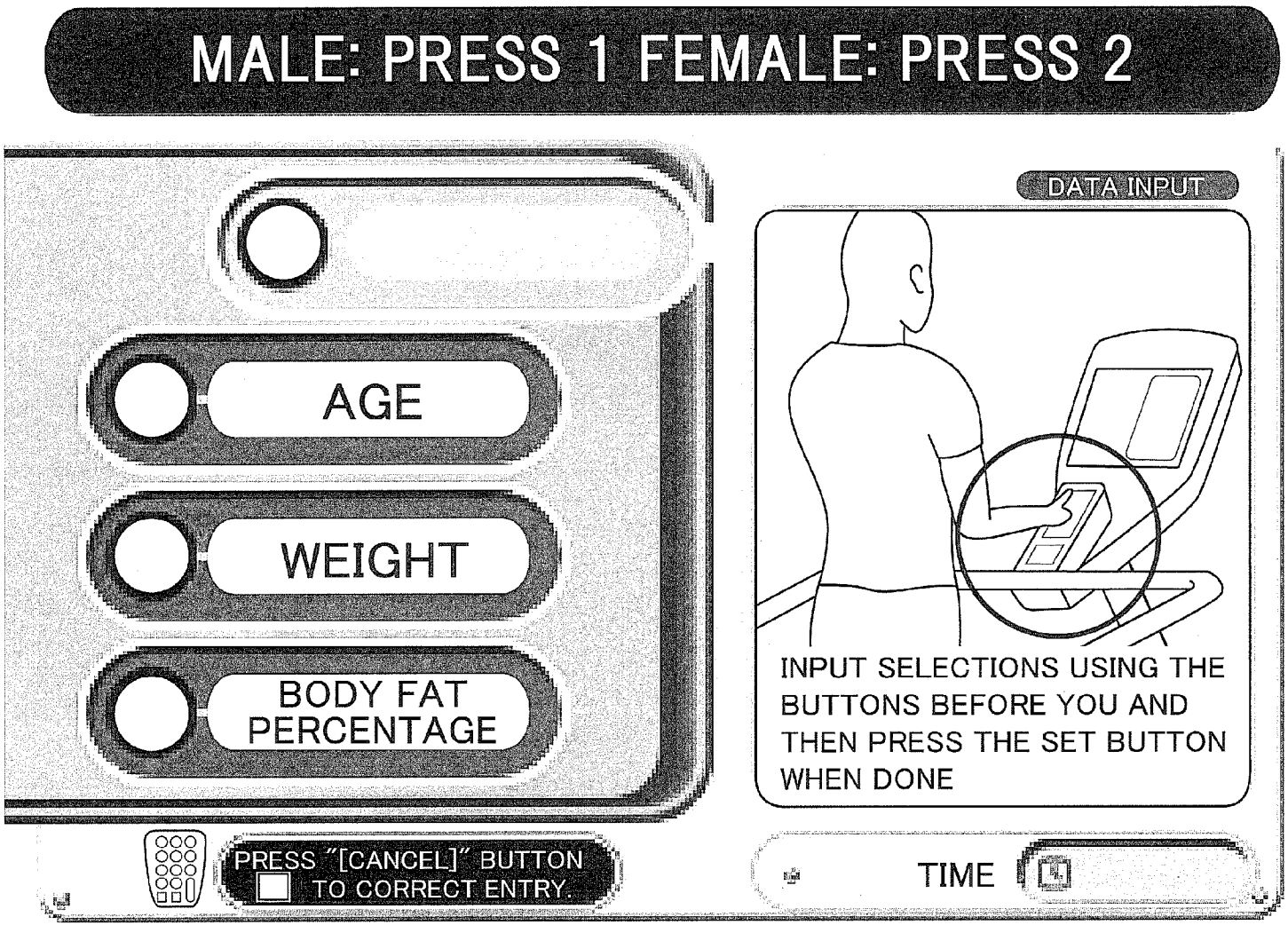
FIG. 4 depicts one example of a screen for receiving the input of personal data.
Figure 5:
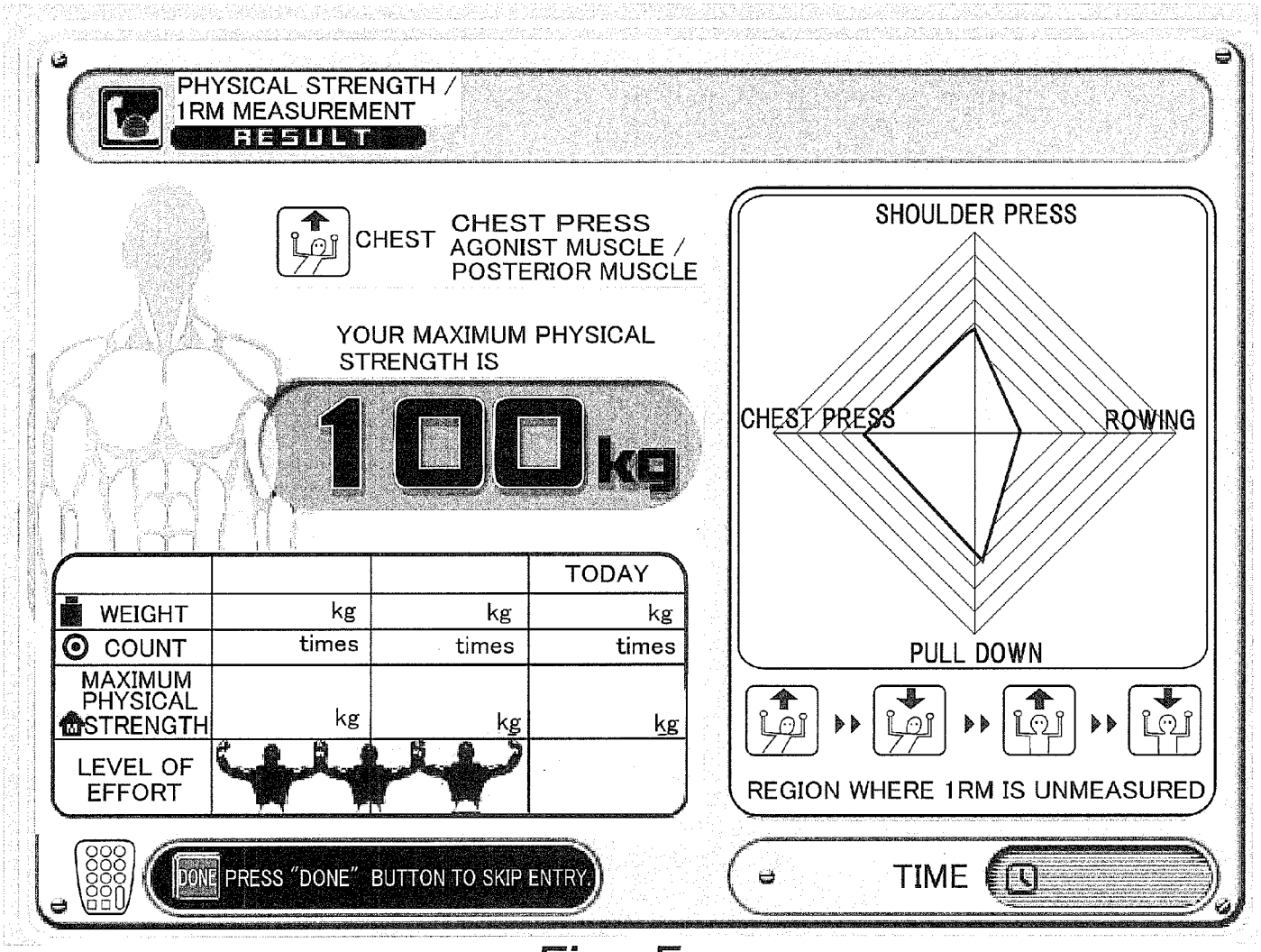
FIG. 5 depicts an example of a screen that displays the result of measuring the maximum physical strength 1 RM.

FIG. 4 is a personal data input receiving screen that is output to the monitor 70 by the calculation unit 36. The trainee inputs missing personal data via the input unit 50. Personal data is, for example, age, gender, body weight, and height. In addition, personal data includes data obtained by measurement. For example, maximum physical strength 1 RM and the range of motion of the handle bar 11 for each type of training, which are discussed above, are personal data obtained by measurement. FIG. 5 is an example of a screen that depicts the maximum physical strength 1 RM measurement result.

Figure 6:
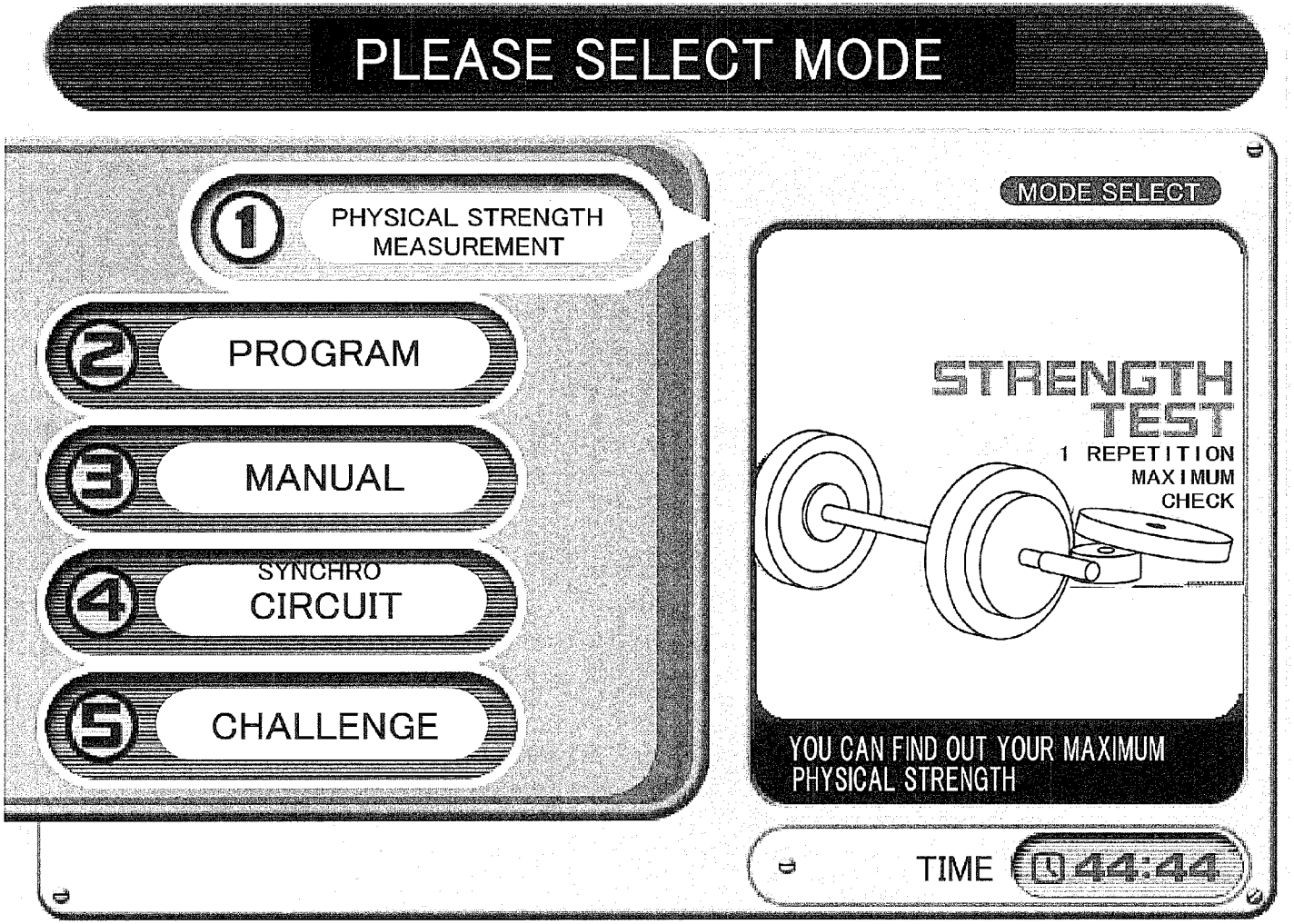
FIG. 6 depicts one example of a mode selection screen.

FIG. 6 is a mode selection screen that is output to the monitor 70 by the calculation unit 36. In this screen, the trainee can select any one of the various modes. In the present embodiment, "measurement mode," "program mode," and "manual mode" can be selected. In the "measurement mode," the calculation unit 36 measures, for each type of training, the region, i.e., the range of motion, through which the trainee can move the handle bar 11. The range of motion is a portional region of the movement area, which is the maximum region through which the handle bar 11 can move, and, as explained above, is the region through which the trainee can move the handle bar 11. The range of motion is determined by a reference position, which is measured by the measurement mode. In the present embodiment, the region from the lower end position (corresponding to the reference position) to the upper end position (corresponds to the reference position) of the handle bar 11, which is moved by the trainee in the "measurement mode," corresponds to the range of motion. However, the range of motion is, of course, not limited thereby if the target training apparatus changes. For example, in the case of a training apparatus wherein, for example, the trainee sits in a chair and arcuately raises and lowers only the calves of his or her legs, then the arcuate region through which the trainee can move becomes the range of motion.

In addition, the range of motion also includes the case wherein only one end of the region through which the trainee can move the moving unit is set. For example, if the handle bar 11 is moved in the upward and downward directions, then only the lower end position (corresponding to the reference position) is set and the upper end position is not set. In contrast to the setting of the lower end position is in the direction in which the handle bar comes downward and is therefore an essential condition to ensure the safety of the trainee, the setting of the upper end position can be omitted. However, setting the upper end position obtains the effect of motivating the trainee to continue the training, i.e., it makes the trainee feel that the load will be released if he or she lifts up just a little bit more, and it is therefore preferable to set both the upper and lower end positions of the range of motion if providing this effect as a function.

In the "measurement mode," an optimal maximum physical strength 1 RM is set for each individual trainee. Specifically, if the personal data (body weight, gender, age, body fat, and the like) of a trainee is accumulated in a fitness club and the like, then an estimated load weight, which is a tentative load weight, is calculated based on that personal data. A load, which is set based on the estimated load weight, is applied to the handle bar 11, a measurement is taken of the number of times that the trainee can raise and lower the handle bar, and the maximum 1 RM of the trainee is determined based on a prescribed equation in accordance with the measured count.

In the "program mode," the calculation unit 36 sets the load, the target count, and the like, and controls the output of images and sound based on these set numeric values. In the "manual mode," a load is received from the trainee, and the output of the images and sound are controlled in accordance with the set load. The manual mode has been provided to enable the trainee to train just as much as he or she desires. Of course, the present invention is not limited thereto, and the setting of a target count may also be received.

Figure 7:
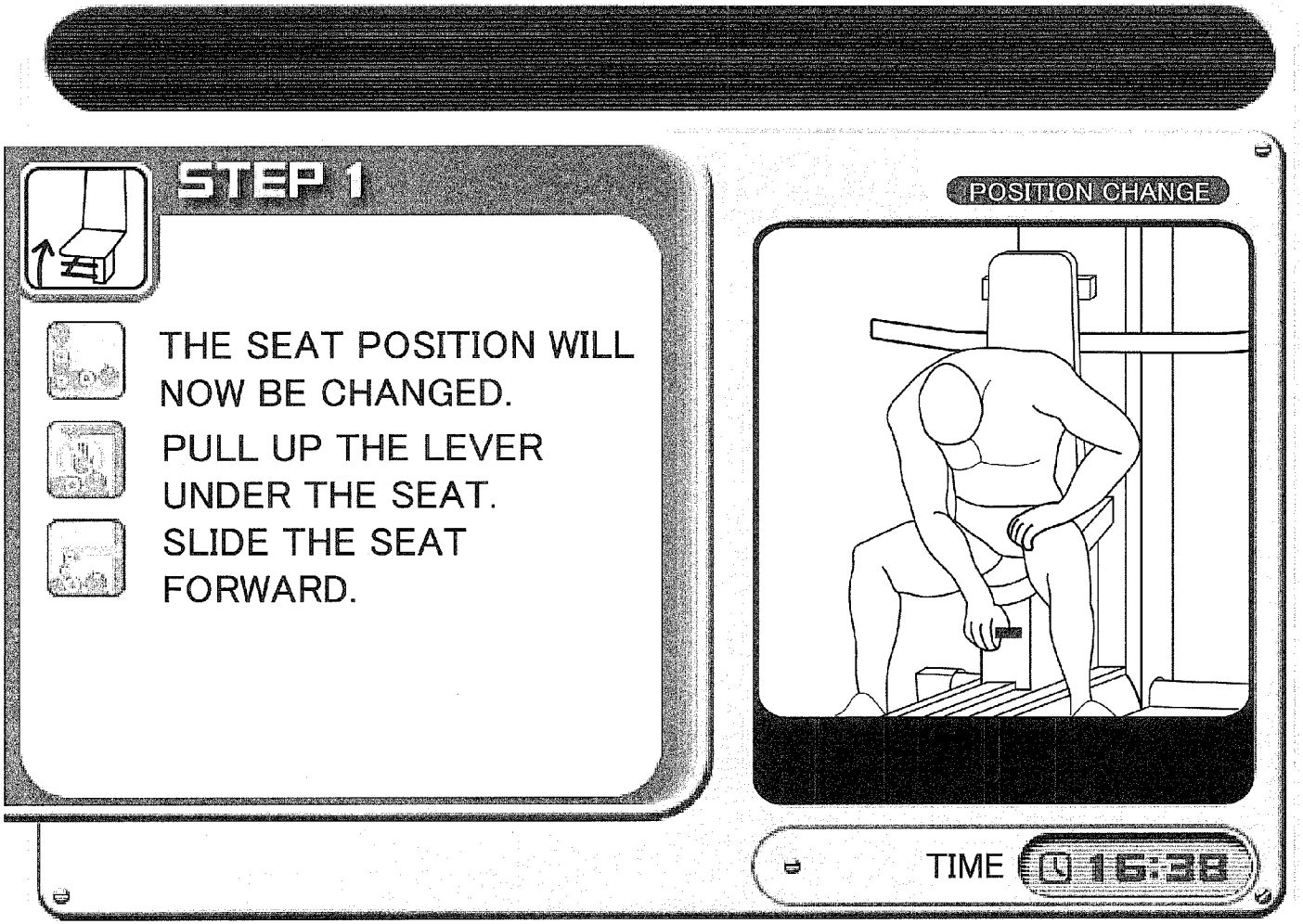
FIG. 7 depicts an example of a screen that indicates the seat position suited to the type of training that the trainee is about to begin.
Figure 8:
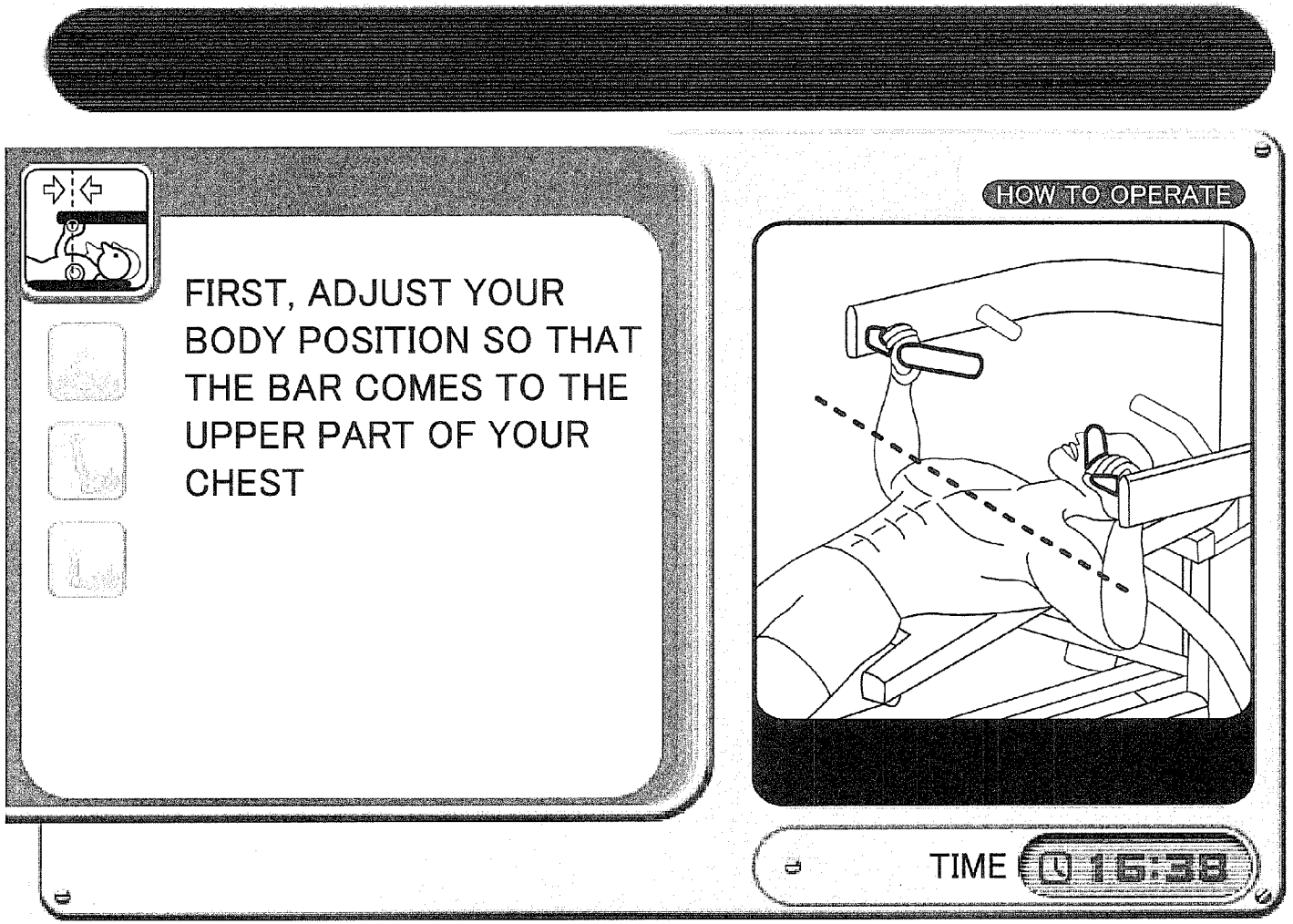
FIG. 8 is an example of a screen that indicates the posture and the training method suited to the type of training that the trainee is about to begin.

FIG. 7 and FIG. 8 are examples of screens that indicate the seat position, the posture, and the like suited to the type of training that the trainee is about to begin, and also indicate the training method. In accordance with the indication, the trainee adjusts the seat position, assumes the training posture, and carries out the training method.

Figure 9:
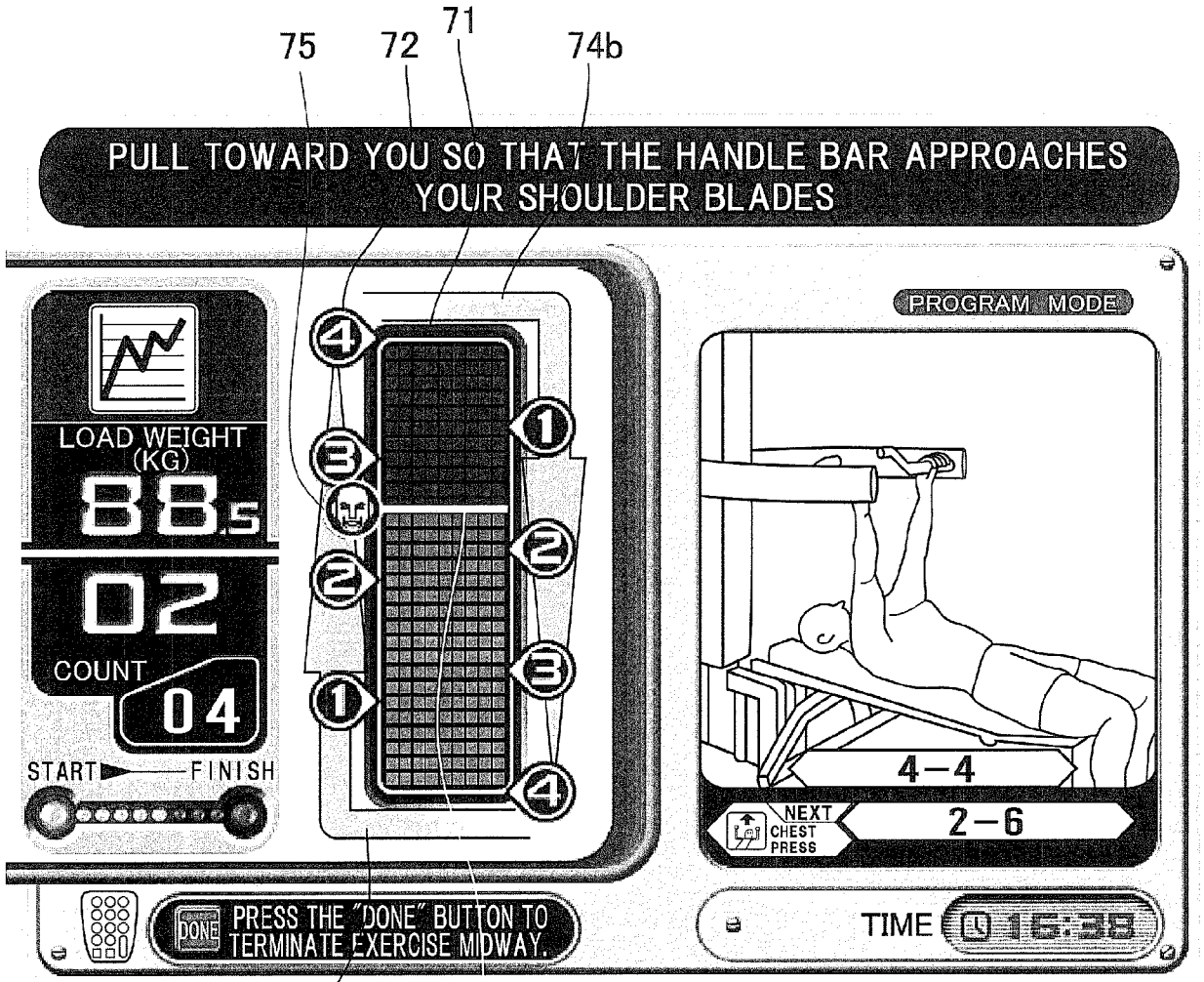
FIG. 9 is an example of a screen displayed in a program mode.

FIG. 9 depicts an example of a screen displayed in the program mode. The calculation unit 36 outputs the load weight, the target count, the executed count, a training sample, and the like on this screen.

Figure 10:
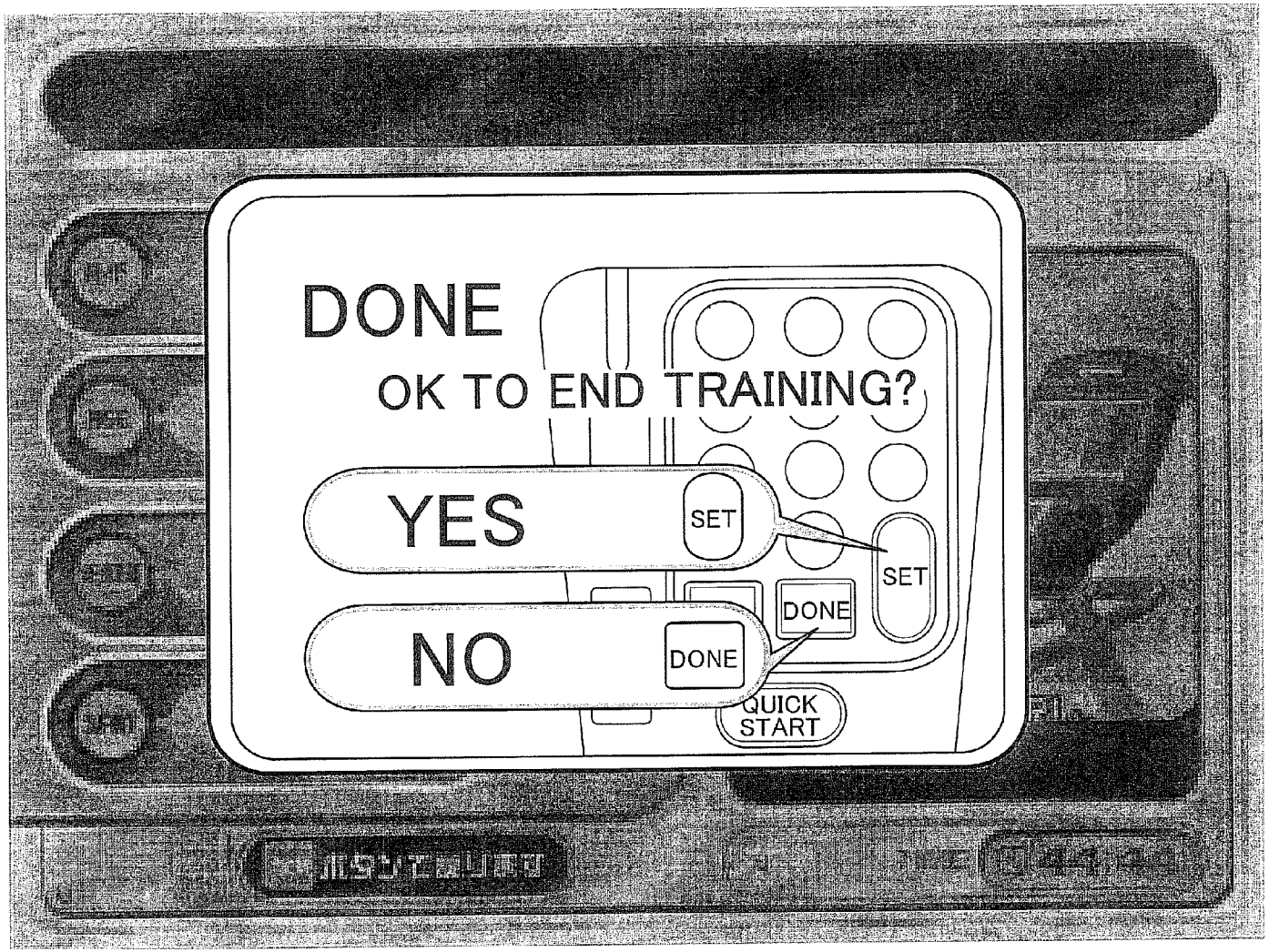
FIG. 10 is an example of a screen displayed when training has finished.

FIG. 10 depicts an example of a screen displayed when the training has finished. This screen receives the selection of whether to end the training.

(B) Exercise Amount Adjustment Function

The calculation unit 36 comprises the moving unit monitoring unit 36*a*, the load adjustment unit 36*b*, the resume support unit 36*c*, and the tempo indicating unit 36*d*. The exercise adjustment function is implemented by the execution of an exercise adjustment program, which is stored in semiconductor memory (not shown), by the units 36*a-d*. The exercise adjustment program adjusts the load applied to the handle bar 11 as well as the specified tempo by which the handle bar 11 is raised and lowered. The functions of the exercise adjustment program are divided into: (1) a load adjustment function, and (2) a specified tempo adjustment function, which are further explained below.

(1) Load Adjustment Function (1-1) Load Reducing Function

The moving unit monitoring unit 36*a* (corresponding to the moving unit monitoring unit) continuously monitors the state of motion (moving state) of the handle bar 11. In the present example, the speed at which the handle bar 11 moves is monitored as the state of motion. The speed at which the handle bar 11 moves is monitored by detecting the rotational speed of the torque motor 15 using the detection signal processing unit 31. If the speed of the handle bar 11 falls below a prescribed value during the prescribed operation time, then the load adjustment unit 36*b* (corresponding to a load adjusting unit) infers that the handle bar 11 has come to rest, and therefore gradually reduces the load applied to the handle bar 11. For example, the load is reduced for each incremental prescribed value $\Delta W$, and a determination is made for each reduction as to whether the speed of the handle bar 11 has reached or exceeded a prescribed value. The prescribed operation time is the training time in which the handle bar 11 must move through one rep. If reducing the load causes the speed of the handle bar 11 to exceed the prescribed value, then the resume support unit 36*c* (corresponding to a resume supporting unit) infers that the trainee has resumed exercise, and maintains the load at that time, at least temporarily. Furthermore, in this case, the resting state of the handle bar 11 includes the case wherein the handle bar 11 has come to a complete stop, and also includes the case wherein the speed of the handle bar 11 has fallen below a prescribed value.

For example, if the trainee stops the movement of the handle bar 11 midway while lifting the handle bar 11, it is inferred that the load W1 is too heavy, and that the trainee is unable to continue the exercise. Furthermore, the load is gradually reduced until the trainee begins to push the handle bar 11 up once again. When the handle bar 11 begins to rise once again, the load W2 at that time is maintained until, for example, the handle bar 11 is fully raised. After reducing the load, the calculation unit 36 may continue the training, as is, with the load W2, and may return from the load W2 to the load W1 after a fixed time period.

In addition, the method of monitoring the state of motion of the handle bar 11 is not limited thereto. For example, the state of motion of the handle bar 11 may be monitored by the calculation unit 36 monitoring the travel time it takes for the handle bar 11 to move from a prescribed start position to a prescribed arrival point. Even if the speed is temporarily lowered during the time period until arriving at the arrival point, if the speed is raised back up again midway and the handle bar 11 arrives at the arrival point within the prescribed time, then the calculation unit 36 infers that the handle bar 11 has not come to a rest. Conversely, if the handle bar 11 does not arrive within the prescribed time, then it is inferred that it has come to a rest, and the load is therefore reduced to support the arrival of the moving unit at the arrival point. This resting of the handle bar 11 is the case wherein the handle bar 11 does not reach the arrival point from the start position within the prescribed time. In addition, the prescribed operation time is the training time within which the handle bar must move through one rep from the start position to the arrival point and back to the start position.

When a trainee can no longer continue an exercise due to fatigue, the training apparatus has a load reducing function that supports the resumption and continuance of the exercise by gradually reducing the load. Consequently, the trainee can feel a sense of accomplishment in that, even though the load was slightly reduced midway, the trainee can say he or she performed the target count of exercises.

(1-2) Load Recovery Function

After reducing the load from the load W1 to the load W2, the load adjustment unit 36*b* of the calculation unit 36 returns the load back to the load W1 at a prescribed timing (corresponding to the load adjusting unit). Specifically, after the handle bar 11 arrives at the prescribed position due to the resumption of exercise, the load is increased within a range that does not exceed the pre-reduction load W1.

Let us consider a case wherein the present apparatus is used as a chest press. If, due to the reduction of the load, the trainee resumes exercise, presses the handle bar 11 upward to the highest point, and then begins to lower the handle bar 11, then the load may be returned to the pre-reduction load with the original weight W1 as the limit. This is because it is normal that the load tolerance of the trainee when lowering the handle bar 11 is lower than the load tolerance of the trainee when raising the handle bar 11. In other words, because the load is supported only when the handle bar 11 is lowered, it is physically easier for the trainee to bear the load compared with the case of pushing the load upward. However, it is preferable that the differential (W3−W2) between the post-reduction load W2 and the load W3, which is the load subsequently returned to, is not too large. This is because in a case where the load differential is too large, but, for example, the exercise is one in which the handle bar 11 is lowered while supporting the load, the strain on the muscles is too great. Specifically, the load W3, which is the load subsequently returned to, should not exceed the pre-reduction load W1 (W3≦W1), and should have as its upper limit 130% to 140% of the post-reduction load W2 (W3≦W2×1.3 to 1.4).

(1-3) Reducing the Load in Accordance with the Direction of Motion

Taking the example of the chest press, the same as above, the load is reduced only when raising the handle bar 11, but does not need to be reduced when lowering the handle bar 11. Namely, the calculation unit 36 monitors the direction of motion of the handle bar 11, and adjusts the load only if the handle bar 11 is being raised. This is because, as discussed above, the load tolerance of the trainee when lowering the handle bar 11 is higher than the load tolerance of the trainee when raising the handle bar 11, and there is therefore little need to reduce the load when lowering the handle bar 11. In other words, because the load is supported only when the trainee is lowering the handle bar 11, it is physically easier to bear the load compared with the case of pressing the load upward. Furthermore, the monitoring of the direction in which the handle bar 11 moves is performed by detecting the rotational direction of the torque motor 15 using the detection signal processing unit 31. Furthermore, the abovementioned reduction of the load will be explained taking as an example an exercise that applies a load to the trainee when pressing the handle bar 11 upward, as in a chest press. Conversely, in the case of an exercise that applies a load to the trainee when lowering the handle bar 11, such as during supine rowing, the load is reduced when the handle bar 11 is pulled downward.

(1-4) Adjustments of the Load in Accordance with the Range of Motion

The load adjustment unit 36*b* of the calculation unit 36 preferably measures the range of motion through which the trainee can move the handle bar 11. The range of motion differs for each trainee. In addition, the range of motion differs for each region of the body that is being trained. Accordingly, the range of motion is measured for each trainee and each type of training. Furthermore, it is generally the case that the range of motion measured at different times differs slightly, even for the same trainee and the same region of the body. Accordingly, it is preferable to set in advance an appropriate amount of margin, a data expiration, and the like for the measured range of motion. Furthermore, the detection of the handle bar 11 position can be derived from the rotational direction and the number of rotations from the initial position of the torque motor 15.

When measuring the range of motion, the calculation unit 36 outputs an indication to the trainee to take an appropriate posture in accordance with the type of training. Furthermore, the calculation unit 36 outputs an indication to the trainee to move the handle bar 11 within the maximum range that the trainee can move such, and detects the highest position and the lowest position of the handle bar 11. The indication should be output by screen and voice. FIG. 7 and FIG. 8 are examples of screens that provide indications on the posture in accordance with the type of training. FIG. 9 is an example of a screen that provides indications to the trainee on a prescribed movement. When the training begins, the calculation unit 36 adjusts the load to zero if the handle bar 11 is positioned outside the measured range of motion.

Here, a prescribed margin, for example, ±5%, should be set in advance for the upper and lower limits of the range of motion. If, for example, the measured highest position is 80 cm and the measured lowest position is 30 cm, then it can be inferred that the position is at the highest position if it is in the range of 76 to 84 cm, and it can be inferred that the position is at the lowest position if it is in the range of 28.5 to 31.5 cm. Furthermore, the load is adjusted to zero if the height of the handle bar 11 exceeds 84 cm or is less than 28.5 cm.

By adjusting the weight of the handle bar 11 to zero outside of the range of motion, it is possible to guarantee safety if the handle bar 11 is positioned outside the range of motion. Namely, there are cases in the conventional art where a dangerous situation could arise if someone working out alone were lifting heavy weights and their physical strength suddenly gave out. However, according to the present invention, even if the handle bar 11 temporarily drops, the load is set to zero if the handle bar 11 moves outside of the range of motion, which reliably ensures the safety of the trainee. Furthermore, instead of abruptly setting the load to zero outside of the range of motion, the load may be sequentially reduced as the position of the handle bar 11 approaches the position outside the range of motion. On the other hand, when the trainee wishes to stop the exercise, he or she can do so at any time simply by moving the handle bar 11 outside the range of motion. Accordingly, if some kind of urgent matter arises while the trainee is exercising, then the trainee can easily deal with it immediately, which provides the training apparatus with excellent operability. In addition, by providing the abovementioned functions the trainee will be free from worry that, for example, the handle bar 11 may fall down, and the trainee can therefore train in a psychologically secure state.

Furthermore, the calculation unit 36 transmits the measured range of motion, along with and associated with the ID, which identifies the trainee, and the training type to a server 200. These values are stored in the server 200 as values that are valid for, for example, one month from the date of measurement. This is because there is a possibility that the range of motion will change over the course of time due to changes in how the trainee moves during measurement and in the physique of the trainee.

(1-5) Counting the Number of Times the Handle Bar is Raised and Lowered

The moving unit monitoring unit 36*a* counts the number of times the handle bar 11 is raised and lowered. One method of counting is to increment the count when the handle bar 11 is moved within the range of 10% of the upper part or lower part of the displayed range of motion. Here, the displayed range of motion is the range within the range of motion that is displayed on the monitor 70.

(1-6) Other

In addition to decreasing the load of the handle bar 11, the calculation unit 36 may also increase the load. For example, if the movement of the handle bar 11 is too fast, i.e., faster than the specified tempo, which is discussed later, then it is conceivable that the load is too light for the trainee. In that case, the calculation unit 36 gradually increases the load, e.g., in increments of $\Delta W$, and monitors the speed of the handle bar 11 with each increase. In addition, the calculation unit 36 calculates a new specified tempo with each increase and then compares the speed of the handle bar 11 with the specified tempo. The load can also be adjusted by gradually increasing the load until the difference between the specified tempo and the speed of the handle bar 11 falls below a specified range so that the load increases to a level appropriate for the trainee. Furthermore, the specified tempo is calculated in accordance with the personal data, the weight of the load, and the like.

(2) Tempo Adjustment Function (2-1) Outputting of the Specified Tempo

The training apparatus 100 may also graphically output an index of the motion timing at which the handle bar 11 should be raised and lowered. For example, to indicate the tempo, which is decided by a combination of the rhythm and the speed, the tempo indicating unit 36*d* (corresponding to the indicating unit) of the calculation unit 36 generates image and voice data and outputs such to the monitor 70 and the speakers 90, respectively. The specified tempo should be calculated in accordance with the personal data, such as age, gender, and physical strength, as well as the weight of the load. Because the training apparatus 100 outputs the specified tempo, the trainee exerts effort to move the handle bar 11 at an appropriate speed, and the effectiveness of the exercise can thereby be expected to increase. Furthermore, the tempo indicating unit 36*d* may output words of encouragement, music, and the like from the speakers 90 suited to the tempo and in accordance with the screen. Therefore, the drudgery of performing the exercise is relieved because the trainee has fun and enjoys performing the exercise.

FIG. 9 is an example of a screen that indicates the specified tempo. This screen displays a range of motion window 71, a rhythm mark 72, a simulation bar 73, direction marks 74, and a direction indication mark 75. The range of motion window 71 displays the trainee's range of motion. The upper end of the range of motion window 71 corresponds to the highest position of the trainee's range of motion, and the lower end of the range of motion window 71 corresponds to the lowest position of the trainee's range of motion. The rhythm mark 72 indicates the rhythm at which the handle bar 11 is raised and lowered. The present example indicates that the handle bar 11 is to be raised and lowered in four-quarter time. The series of numbers (1, 2, 3, and 4) of the rhythm mark 72 indicate the sequences of the movement. The simulation bar 73 rises and falls at a specified speed in the range of motion window 71. The trainee should also exert effort to raise and lower the handle bar 11 in accordance with the rising and falling motion of the simulation bar 73.

The direction marks 74 and the direction indication mark 75 specify the direction of motion of the simulation bar 73 as well as the handle bar 11. If the direction indication mark 75 is moving in line with a direction mark 74*a*, which points upward, then it indicates that the handle bar 11 is to be lifted. Conversely, if the direction indication mark 75 is moving in line with a direction mark 74*b*, which points downward, then it indicates that the handle bar 11 is to be lowered. Furthermore, the specification of the direction marks 74*a*, 74*b* switches every time the direction indication mark 75 rises and falls, synchronized to the simulation bar 73, in the range of motion window 71 and reaches the upper end or the lower end thereof.

(2-2) Adjustment of the Tempo

If the trainee stops the exercise midway, then the calculation unit 36 may output a specified tempo regardless of the actual movement of the handle bar 11, but may also relax the tempo that is output in accordance with the actual movement of the handle bar 11. For example, if the speed of the handle bar 11 falls below a prescribed value, then the calculation unit 36 may relax the specified tempo in accordance with the speed of the handle bar 11. If the trainee can keep pace with the relaxed tempo, then he or she can obtain a sense of satisfaction because he or she is able to continue the exercise without changing the load.

In addition, if the difference between the specified tempo and the movement of the handle bar 11 exceeds a prescribed range, then the specified tempo may be decreased or increased. This is to prevent the situation wherein the output of the specified tempo becomes irrelevant if the abovementioned difference becomes too large.

(2-3) Combining the Adjustment of the Load and the Adjustment of the Tempo

There are cases in which it is more preferable to combine the adjustment of the tempo with the adjustment of the load.

Let us consider an example wherein, when the speed at which the handle bar 11 is pushed up slows down, the specified tempo is slowed while reducing the load. If the fatigue level of the trainee is high, then slowing the specified tempo in addition to decreasing the load makes it easier for the trainee to resume exercise, which is preferable. At this time, the load should be minimally reduced to the level that enables the trainee to resume training, and the specified tempo should be slowed to the level at which the difference between the specified tempo and the movement of the handle bar 11 falls within a prescribed range.

In addition, let us consider an example wherein, if the trainee resumes exercise at the reduced load W2, then the specified tempo is increased in accordance with the reduced specified tempo. In so doing, it is possible to supplement the amount of exercise performed, which is reduced by the amount that the load was reduced, by increasing the tempo. The trainee can thereby attain a sense of accomplishment by increasing the speed of the exercise, even though the load was reduced. For example, if the speeds corresponding to the specified tempos before and after the load reduction are V1, V2, respectively, then the specified tempo may be determined so that the value of (W2·V2)/(W1·V1) is within a prescribed range.

The specified tempo is preferably adjusted based on personal data, such as age, gender, and physical strength, the weight of the load, as well as the value of the pre-reduction load and the difference in the load before and after reduction.

Furthermore, if a method is adopted that decreases the speed or slows the tempo in response to the load reduction, then it is preferable not to play background music. This is because, originally, background music is synchronized to the abovementioned tempo in order to set the rhythm of the exercise; therefore, if the tempo is slowed, then that music will also play slowly and, unfortunately, the trainee will perceive his or her own state of fatigue, and there is a risk that this will end up reducing, instead of enhancing, the sense of accomplishment of the exercise.

(2-4) Range of Motion to be Displayed (Displayed Range of Motion)

The tempo indicating unit 36*d* of the calculation unit 36 preferably sets the displayed range of motion, which is displayed in the range of motion window 71 on the monitor 70, to a range that is narrower than the measured range of motion. For example, the displayed range of motion should be set to a range wherein the upper and lower ends of the actual range of motion are tightened by 10%. In so doing, even if the trainee, who is looking at the monitor 70, is at the point where he or she thinks that the handle bar 11 has reached the lower end of the range of motion, the handle bar 11 does not deviate from the true range of motion unless it is lowered an additional 10%. Conversely, when raising the handle bar 11, the simulation bar 73 is displayed at the lower end of the range of motion window 71 on the monitor 70 when the handle bar 11 is in a state wherein it is lifted by just 10% from the true lower end of the range of motion.

The following explains why the displayed range of motion, which is a range narrower than the true range of motion, is displayed on the monitor 70. Namely, the trainee needs to exert effort when, for example, pushing the handle bar 11 upward because the handle bar 11 already enters the range of motion before the movement of the handle bar 11 is displayed on the monitor 70. The operation requested of the trainee before the simulation bar 73 is displayed serves the role of a preparatory operation for the trainee. Because it is difficult for a human being to instantaneously output a prescribed force, the performance of such a preparatory operation makes it possible for the trainee to accelerate the movement of the handle bar 11 and smoothly oppose the load in accordance with the movement of the simulation bar 73, which is rising from the lower end of the range of motion window 71, on the monitor 70. If we assume that the range of motion window 71 on the monitor 70 is matched to the full range of the measured range of motion, then the trainee must output the prescribed force in one stroke from the lower end of the range of motion window 71, e.g., when raising the handle bar 11. Unfortunately, this reduces the usefulness of the training apparatus. To prevent this, it is preferable to display the simulation bar 73 in the range of motion window 71 so that the simulation bar 73 corresponds to a displayed range of motion that is narrower than the true range of motion.

Process Flow

The following cites an embodiment to explain the process executed by the calculation unit 36 of the training apparatus 100. To facilitate the explanation, the following takes as an example a case wherein the amount of exercise is adjusted by adjusting the load. The calculation unit 36 principally executes (1) a main routine, and (2) a load adjustment routine. The load adjustment routine is executed independently of the main routine.

(1) Main Routine

Figure 11:
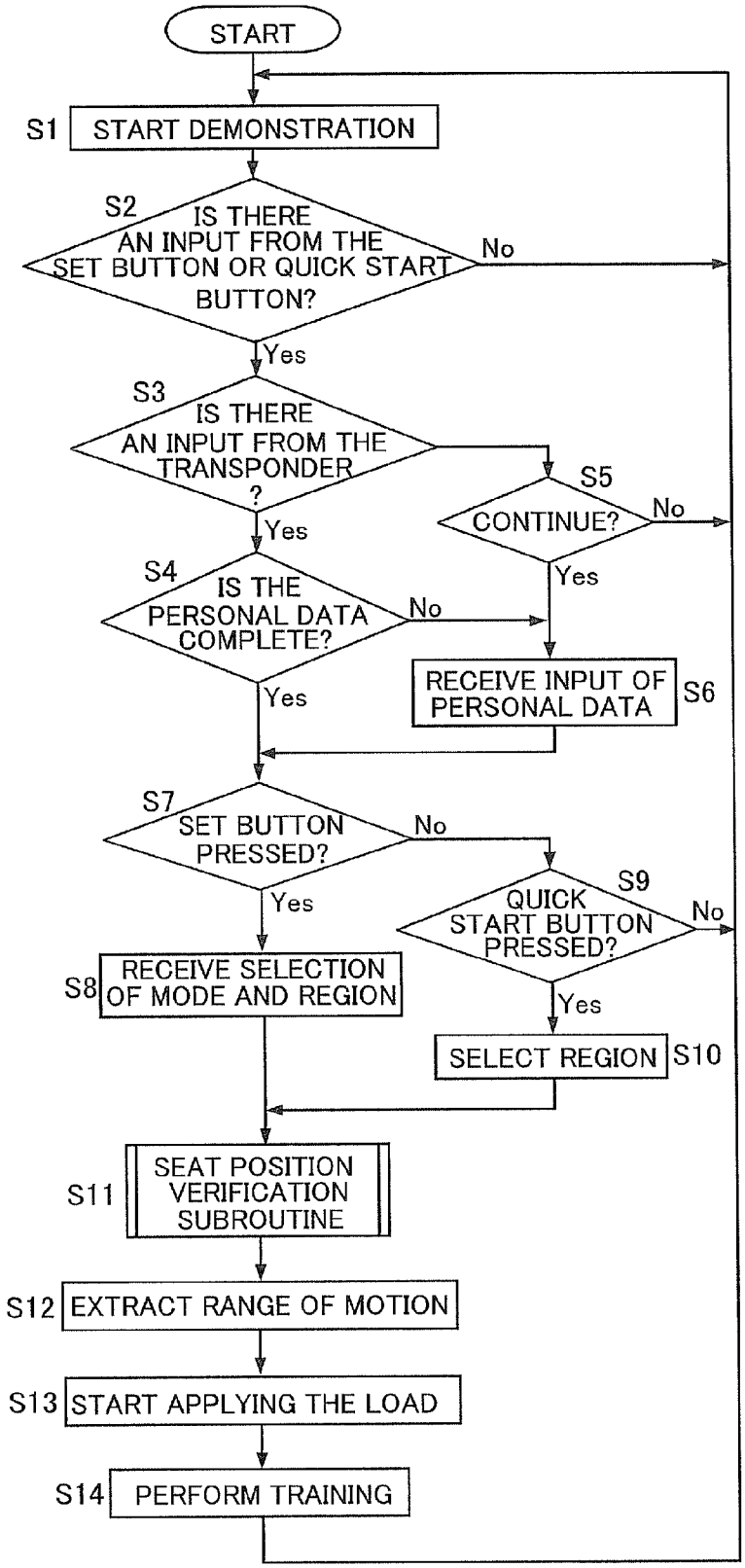
FIG. 11 is a flow chart that depicts one example of the flow of a main routine executed by the calculation unit in FIG. 1.

FIG. 11 is a flow chart that depicts one example of the flow of the main routine executed by the calculation unit 36. The main routine acquires the personal data, determines the need to measure the range of motion of the trainee, performs the process for each mode, and the like.

Step S1: When the training apparatus 100 starts up, the calculation unit 36 starts a demonstration, which describes an overview of the training method.

Step S2: While executing the demonstration, the calculation unit 36 stands by for the input of the set button or the quick start button. The set button and the quick start button are provided to the input unit 50.

Steps S3-S6: The calculation unit 36 acquires the personal data from the server 200, or has the trainee input such. Specifically, if the user ID is input by the transponder during the demonstration (S3), then the calculation unit 36 acquires the personal data corresponding to the inputted user ID from the on-site server 200. If there are no omissions in the acquired personal data (S4), then the method transitions to step S7. If there is no input from the transponder (S3), then the calculation unit 36 outputs a notification to the effect that it cannot authenticate the trainee, and then inquires about the intention to continue the process (S5). If there is an intention to continue, then a data input screen (refer to the abovementioned FIG. 4) is displayed, and the input of the personal data is received (S6). In addition, even if there is an omission in the personal data acquired from the on-site server 200, then the input of the personal data is received from the data input screen (S4, S6).

Steps S7-S8: If the set button is pressed during the demonstration (S7), then the calculation unit 36 receives the mode and region selections from the trainee.

Steps S9-S10: If the quick start button is pressed (S9), then the calculation unit 36 sets the "manual mode" and receives the region selection from the trainee (S10). In addition, the calculation unit 36 may receive settings, such as the load and the target count.

Step S11: The calculation unit 36 executes a seat position verification subroutine, which is discussed later. This process prescribes the seat position in accordance with the region of the training about to be performed.

Step S12: When the region of training and corresponding seat position are prescribed by the abovementioned steps S8, S10, S11, the calculation unit 36 extracts from the personal data the range of motion of the trainee for that training region.

Step S13: The calculation unit 36 impresses a load, which is in accordance with the set mode, the training region, and the like, upon the handle bar 11. As will be discussed later, the load of the handle bar 11 changes in accordance with the state of motion of the handle bar 11 during training.

Step S14: The calculation unit 36 starts the training process in accordance with the set mode, selected region, and the like. For example, if the "manual mode" is selected, then the calculation unit 36 starts a program that controls the output of the screen and the voice in accordance with the region and load of the training selected by the trainee and the setting of the target count. In addition, if the "program mode" is set, then the calculation unit 36 starts a program that outputs a screen and voice in accordance with a pre-stored training program corresponding to the selected region. This program sets the load, the target count, and the like based on the personal data, such as the maximum physical strength 1 RM, the gender, the age, and the like, of the trainee. The load adjustment routine (discussed in detail later), which is executed independently of this main routine, outputs to the monitor 70 the indicated tempo, the current load value, and the like during the training process. After the training process is finished, the calculation unit 36 saves the exercise result in the on-site server 200, and the method then returns to step S1. Furthermore, the conditions under which the training process finishes include the case wherein it finishes by the completion of the training, and the case wherein the training process finishes by an instruction from the load adjustment routine, which is discussed later.

Figure 12:
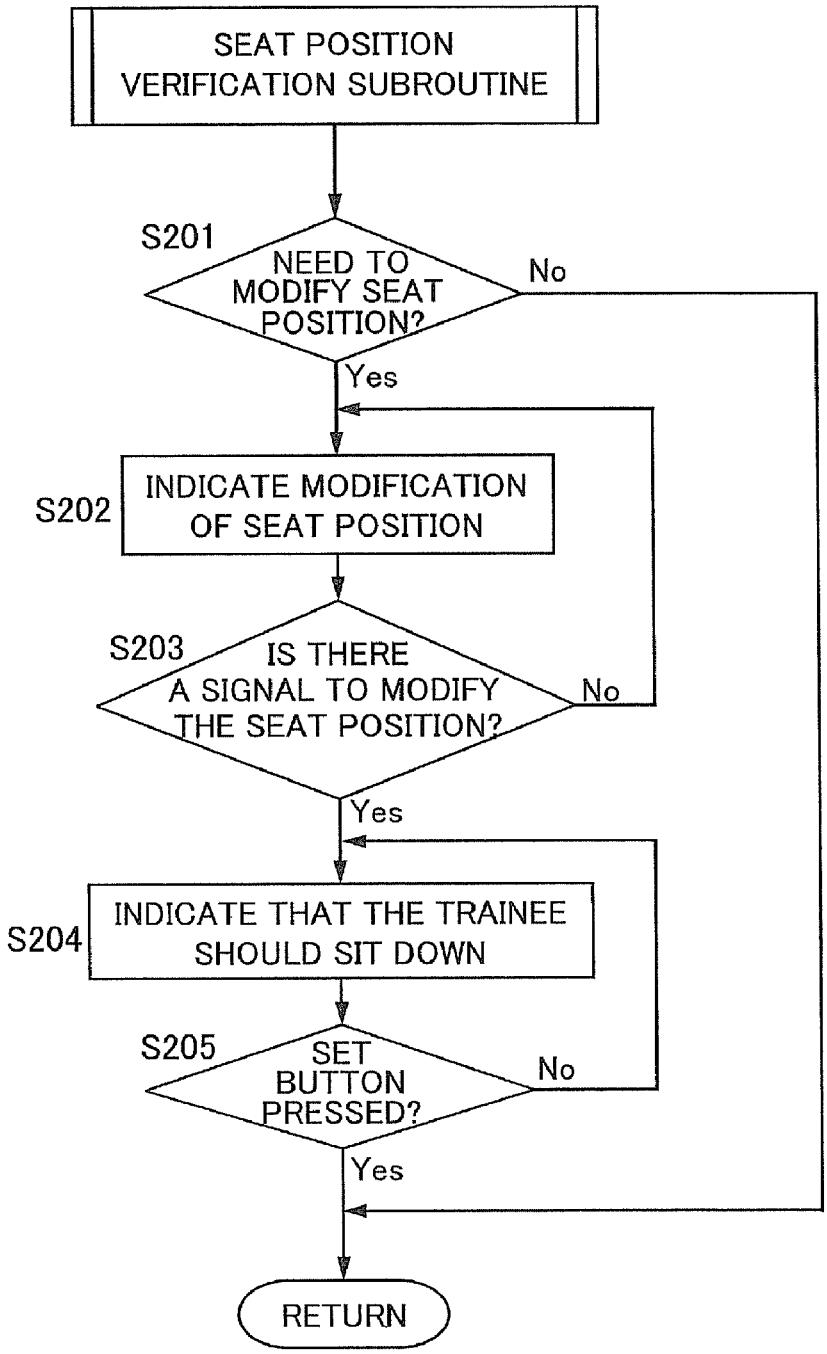
FIG. 12 is a flow chart that depicts one example of the flow of a seat position verification subroutine, which is executed in step S11 of the main routine in FIG. 11.

FIG. 12 is a flow chart that depicts one example of the flow of the process of the seat position verification subroutine executed by the calculation unit 36. If the main routine transitions to step S11, then the following process begins.

Steps S201, S202: Based on the region of the training about to be performed, the calculation unit 36 determines whether there is a need to modify the seat position (S201). If there is a need to make a modification, then the method transitions to step S202 and outputs a screen, which indicates the seat position modification to be performed, to the monitor 70. If a modification is not needed, then the method returns to the main routine.

Steps S203, S204: The calculation unit 36 stands by for the modification of the seat position (S203); if the seat position is modified, then a screen, which provides an indication to the trainee to sit down, is outputted to the monitor 70 (S204). The modification of the seat position is determined by the detection of signals from the abovementioned bar switches 21*a, b* and seat switches 22*a, b*.

Step S205: The calculation unit 36 stands by for the trainee to press the set button (S205), and the method then returns to the main routine.

(2) Load Adjustment Routine

Figure 13A:
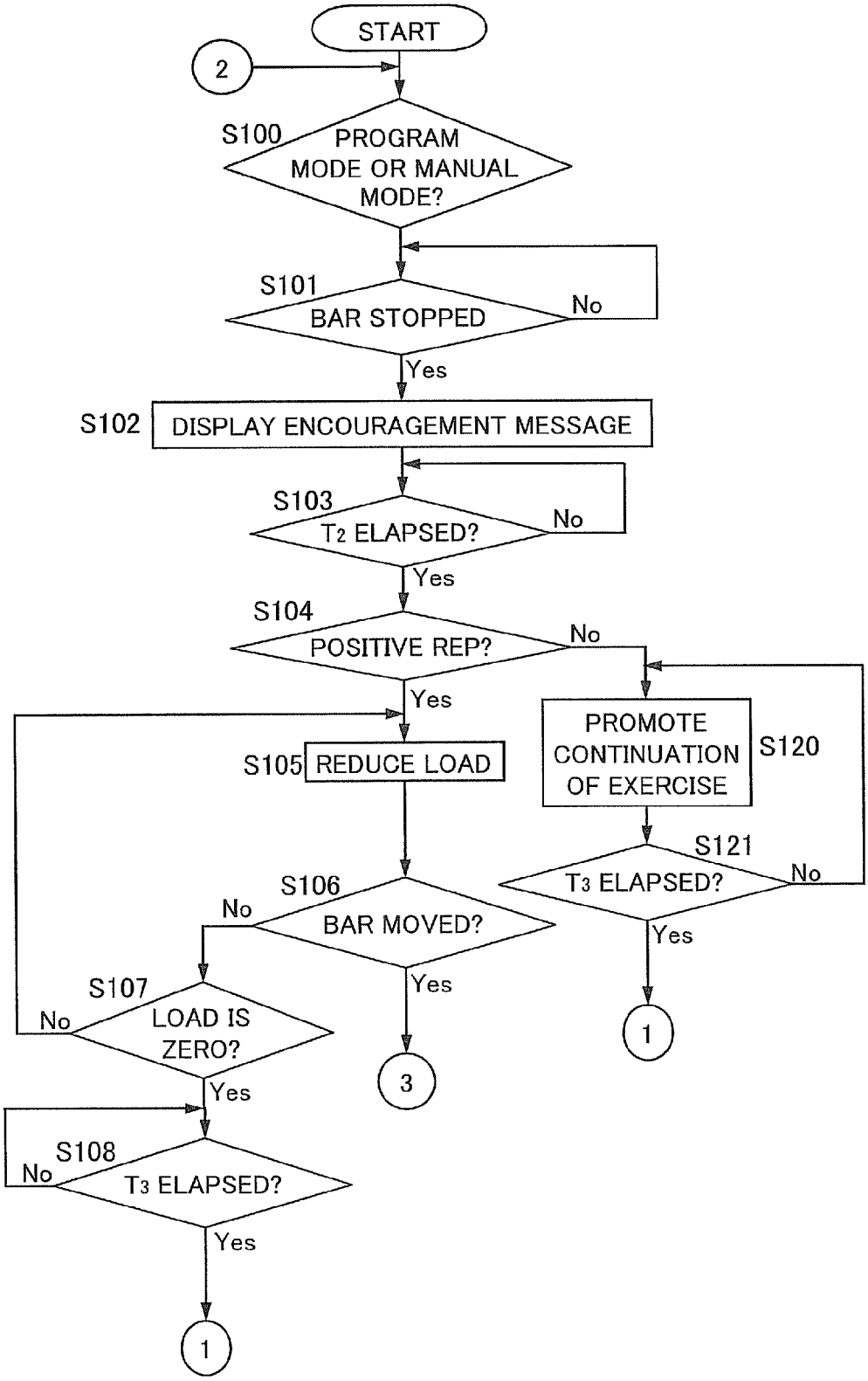
FIG. 13A is a flow chart that depicts one example of the flow of a load adjusting routine executed by the calculation unit in FIG. 1.
Figure 13B:
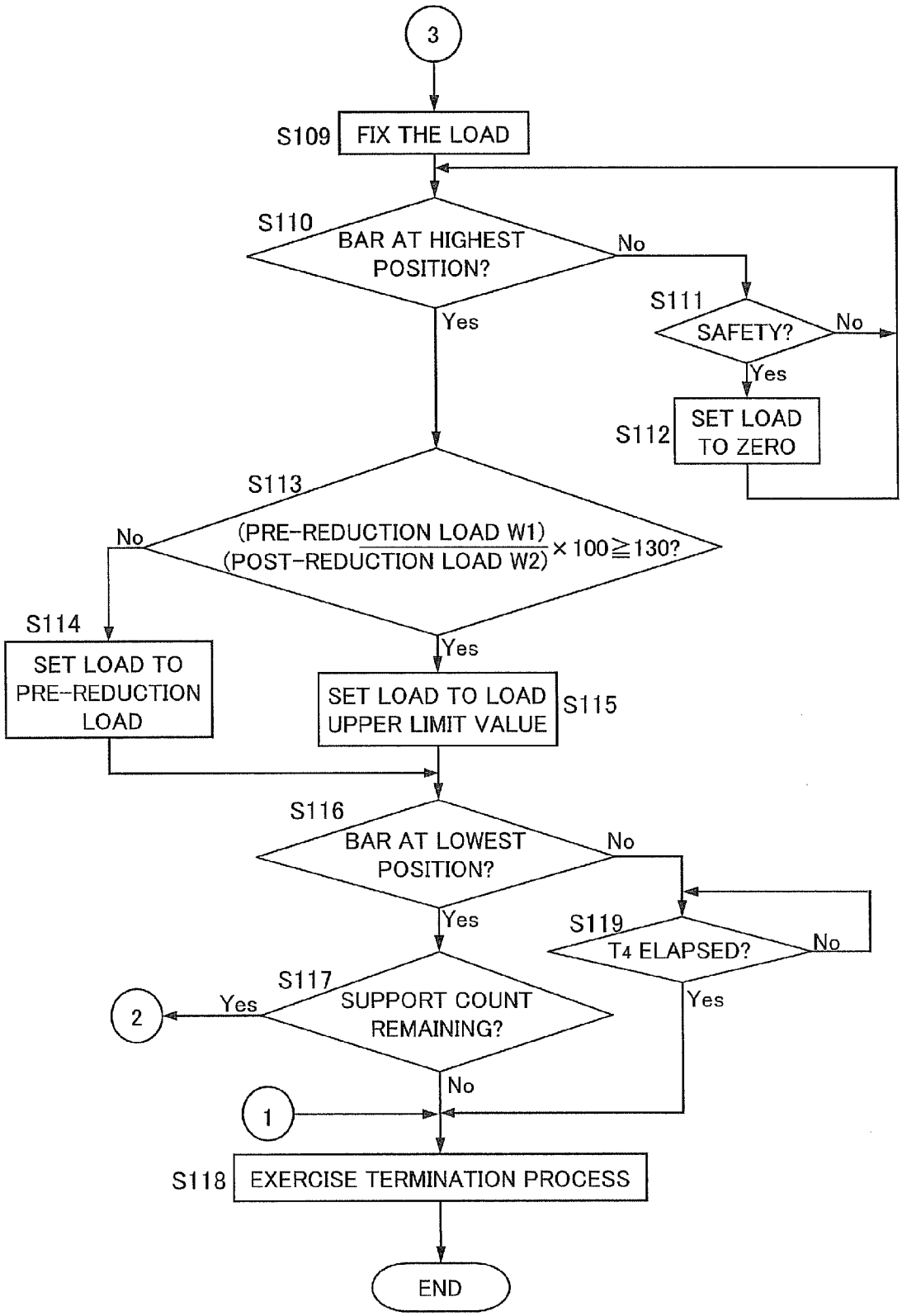
FIG. 13B is a flow chart that depicts one example of the flow of the load adjusting routine executed by the calculation unit in FIG. 1.

FIGS. 13A and B are flow charts that depict one example of the flow of the load adjustment routine executed by the calculation unit 36. In the present example, the calculation unit 36 executes the load adjustment routine when the process is executed in the program mode or the manual mode. This process is performed in accordance with the following flow.

Flow starting phase: If the movement of the trainee lifting the handle bar 11 is substantially stopped (S100-S104), then the load is gradually reduced (S105-S107), and the value of the load when the movement resumes is maintained until the handle bar 11 is fully raised (S109).

Flow middle phase: If the handle bar 11 is fully raised, then the load is returned to within the prescribed limits (S110-S115).

Flow ending phase: If the handle bar 11 is fully lowered, then a determination is made as to how many more times the load can be reduced, and the exercise is finished if the load cannot be further reduced (S116-S118).

(2-1) Flow Starting Phase

Step S100: The calculation unit 36 determines whether the program mode or the manual mode is set. This is in order to not reduce the load when, for example, moving the bar in the measurement mode, or when measuring the maximum physical strength.

Steps S101-S102: The calculation unit 36 monitors whether the speed at which the handle bar 11 moves falls below a prescribed speed (S101); if the speed of the handle bar 11 falls below the prescribed speed, then the calculation unit 36 infers that the movement of the trainee has stopped and outputs an encouragement message (S102).

Steps S103-S104: If the speed of the handle bar 11 falls below the prescribed speed even though a prescribed time T2 has elapsed (S103), then the calculation unit 36 determines whether the direction in which the handle bar 11 is moving is upward (which is called a positive rep) or downward (which is called a negative rep) (S104).

Step S105: If the handle bar 11 is moving upward, then the calculation unit 36 reduces the load by a fixed amount (pre-reduction load W1=W1−ΔW).

Step S106: The calculation unit 36 determines whether, as a result of the reduction, the handle bar 11 has begun to move at the prescribed speed or faster (S106). For example, if the speed of the handle bar 11 is below a prescribed value even though a prescribed time or longer has elapsed, then it is determined that the handle bar 11 is not moving (S106).

Step S107: If the speed of the handle bar 11 does not reach or exceed the prescribed value even if the load is reduced, then the calculation unit 36 determines whether the load can be further reduced. Namely, the calculation unit 36 determines whether the load is greater than zero. If the load is not zero, then the method returns once again to step S105. In so doing, the calculation unit 36 reduces the load in ΔW increments until it reaches zero, and stands by for the handle bar 11 to begin moving.

Step S108: If the reduced load reaches zero, then the calculation unit 36 instructs the main routine to end the exercise, and the process thereby ends. This is because it can be inferred that the trainee has no will to continue training because the handle bar 11 has not begun to move even though the load has reached zero.

Step S109: If the handle bar 11 begins to move as a result of the load reduction, then the calculation unit 36 stops any further reduction of the load and maintains the post-reduction load value W2.

(2-2) Flow Middle Phase

Step S110: The calculation unit 36 maintains the load W2 until the handle bar 11 arrives at the upper end of the range of motion. The determination of whether the handle bar 11 has arrived at the upper end is preferably made by allowing some margin.

For example, if the highest position of the range of motion is Lt, then the calculation unit 36 infers that the handle bar 11 has arrived at the upper end of the range of motion if it enters a height range of 0.95×Lt to 1.1×Lt. Likewise, if the lowest position of the range of motion is Lb, then the calculation unit 36 infers that the handle bar 11 has arrived at the lower end of the range of motion if it enters a height range of 0.95×Lb to 1.1×Lt. This is because the range through which the trainee moves the handle bar 11 does not precisely match the range of motion every stroke, but actually deviates somewhat from the range of motion each time.

Steps S111-S112: If the handle bar 11 enters a safety zone beyond the upper end of the range of motion (S111), then the calculation unit 36 sets the load to zero (S112). Namely, if the handle bar 11 rises and exceeds a height of 1.05×Lt, then the calculation unit 36 infers that the handle bar 11 has gone outside of the range of motion and therefore sets the load to zero.

Furthermore, in the present embodiment, the determination of whether the handle bar 11 has reached the upper end is performed by determining whether the handle bar 11 has reached the highest position of the range of motion, but that determination is not necessarily limited thereto; for example, if the handle bar 11 reaches a prescribed height even though it is still within the range of motion, then it is assumed that the upper end has been reached and the monitor 70 outputs a display to that effect, the trainee is instructed to move the handle bar 11 in the reverse direction, and then the load may be set as described above.

For example, if, depending on the apparatus, only the lower end position is set for when the handle bar has descended, then the range of motion may not be set for the upper end position, in which case the load should be set as described above.

Step S113: If the handle bar 11 arrives at the upper end of the range of motion, then the calculation unit 36 determines whether it is acceptable to return the load to the original load. This is accomplished by determining whether the differential between the pre-reduction load W1 and the post-reduction load W2 exceeds a prescribed upper limit. For example, if the pre-reduction load W1 is less than 130% of the post-reduction load W2, then it is determined that it is acceptable to return the value of the load to the original value W1.

Step S114: If the differential between the pre-reduction load W1 and the post-reduction load W2 does not exceed the prescribed upper limit, then the calculation unit 36 returns the load to W1. For example, if W1<W2×1.3, then the load is returned to W1.

Step S115: If the differential between the pre-reduction load W1 and the post-reduction load W2 exceeds the prescribed upper limit, then the calculation unit 36 increases the load to that upper limit. For example, if W1>W2×1.3, then the load is returned to W2×1.3.

(2-3) Flow Ending Phase

Steps S116-S118: If the handle bar 11 arrives at the lower end of the range of motion (S116), then the calculation unit 36 sets a support count Ns to (Ns+1) and compares the updated support count Ns with a prescribed support count Nmax (S117). If Ns<Nmax, then the method returns once again to steps S101, where the continuation of training is supported by reducing the load when the movement of the trainee stops. Conversely, if Ns≧Nmax, then the calculation unit 36 instructs the main routine to end the exercise, and the process thereby ends (S118).

Step S119: If the time from when the handle bar 11 moves from the upper end of the range of motion until it arrives at the lower end exceeds a prescribed time T4, then the calculation unit 36 instructs the main routine to finish the exercise, and the process thereby ends (S118). For example, if the speed at which the trainee lowers the handle bar 11 is too slow, then it is inferred that the training has finished. The load adjustment routine ends and the main routine returns to displaying the demonstration (S1).

Steps S120-S121: Furthermore, if the handle bar 11 is substantially stopped in the downward moving state (S120) and does not move even if a prescribed time T3 is exceeded, then the calculation unit 36 ends the present process (S121). For example, if the trainee abandons training midway while lowering the handle bar 11, then the calculation unit 36 infers that the training has finished.

Furthermore, although the abovementioned load adjustment routine adjusts the load when in the program mode and the manual mode, the training apparatus 100 may be provided with any kind of mode and the load may be appropriately adjusted depending on the mode selected. In addition, with the abovementioned routine, the training ends if the routine is executed until a load adjustment count reaches an upper limit, but that is not necessarily required. Furthermore, after the load is reduced from the load W1 to the load W2 and the handle bar 11 is fully raised, the load is once again increased, but that is not necessarily required. For example, the reduced load W2 may be maintained as is, and the training continued until the end. In addition, the load is adjusted only when the handle bar 11 is being raised; however, with apparatuses wherein other types of training are performed, it is also possible to adjust the load regardless of the direction of movement of the moving unit that is driven by the trainee.

As discussed above, when the training apparatus according to the present invention detects the fatigue of the trainee, it supports the trainee so that he or she can continue the training. Because support is given to the minimum extent needed for the trainee to resume training, the trainee can feel an appropriate sense of accomplishment after the training. The load is gradually reduced to the level at which the muscles are not heavily strained. In addition, because the support count is preferably provided with an upper limit, it is possible to prevent burdening the trainee with the reduction of the load. In addition, if the load is adjusted in a direction of exercise wherein the trainee has little load tolerance, it is further preferable to keep that adjustment to the minimum level needed to support the trainee.

Other Embodiments (A) In the above first embodiment, the load was adjusted only when the fatigue of the trainee was detected, but the specified tempo for raising and lowering the handle bar 11 may be adjusted along with the load. For example, the specified tempo can be increased instead of reducing the load, or the specified tempo can be slowed if the fatigue of the trainee is detected.

(B) The present invention encompasses the program for executing the method discussed above on a computer, as well as computer readable storage media whereon such a program is recorded. Here, the program may be a downloadable program. Further, the storage media may be a computer readable flexible disk, a hard disk, semiconductor memory, a CD-ROM, a DVD, a magneto-optic disk (MO), and the like.

The present invention can be adapted to a training apparatus for an individual to exercise on ones own at the optimal exercise load.

General Interpretation of Terms

In understanding the scope of the present invention, the term "configured" as used herein to describe a component, section or part of a device includes hardware and/or software that is constructed and/or programmed to carry out the desired function. In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A training apparatus that applies a first load to a moving unit, which is provided for the purpose of exercise, by using an electrical load generator, comprising:

a moving unit monitoring unit that monitors the movement of said moving unit when said moving unit is moving;

a load adjusting unit that gradually reduces the load from said first load to a second load until the moving unit monitoring unit detects that the moving unit starts moving again after the moving unit monitoring unit detects that the moving unit has come to a rest; and said moving unit is movable in a first direction, and a second direction which is the reverse direction of said first direction; said moving unit monitoring unit further monitors the direction of motion of said moving unit; and if said load adjusting unit changes the load from said first load to said second load when said moving unit is moving in one direction, then said load adjusting unit will set the load to a third load when said moving unit monitoring unit detects that the direction of motion of said moving unit has switched to another direction.

2. A training apparatus as recited in claim 1, wherein the load adjusting unit sets said second load to be lower than said first load when said prescribed state is the resting state of said moving unit.

3. A training apparatus as recited in claim 1, further comprising:

a setting unit that sets at least one reference position in the area in which said moving unit moves;

wherein if said moving unit travels beyond said reference position along a preset direction of motion of said moving unit with respect to said reference position, said moving unit will be stopped or the load applied to the exercise will be set to zero.

4. A training apparatus as recited in claim 1, wherein said load adjusting unit maintains said second load until said moving unit monitoring unit detects that the direction of motion of said moving unit has been switched.

5. A training apparatus as recited in any one claim of claim 1, wherein said moving unit is movable in a first direction, and a second direction which is the reverse of said first direction;

said moving unit monitoring unit further monitors the direction of motion of said moving unit; and said load adjusting unit reduces the load from said first load to said second load only when said moving unit is moving along said first direction.

6. A training apparatus as recited in claim 2, wherein said moving unit monitoring unit monitors the speed of movement of said moving unit and determines whether said speed has fallen below a prescribed value for a prescribed period of time; and if said speed has fallen below a prescribed value for the prescribed period time, then said load adjusting unit will reduce the load from said first load to said second load.

7. A training apparatus as recited in any one claim of claim 1, further comprising:

a display unit; and an indicating unit that outputs to said display unit an indication related to the timing at which said moving unit is being moved.

8. A training apparatus as recited in claim 7, wherein said indicating unit outputs an indication related to said timing by graphically displaying on said display unit an index of the timing at which said moving unit is being moved.

9. A training apparatus as recited in claim 7, wherein said moving unit monitoring unit monitors the speed of movement of said moving unit; and said indicating unit changes the indicated timing in response to changes in the speed of said moving unit.

10. A training apparatus as recited in claim 4, wherein when said moving unit monitoring unit detects that the direction of motion of said moving unit has been switched, said load adjusting unit will adjust said third load to a range that is less than said first load and greater than or equal to said second load.

11. A training apparatus as recited in claim 7, wherein if said load adjusting unit reduces the load from the first load to the second load when said movable unit is stopped, and then said moving unit starts to move again, said indicating unit will indicate the movement of said moving unit in accordance with the reduced load.

12. A training apparatus as recited in claim 3, wherein said training apparatus further comprises a seat unit configured to switch between a first position and a second position; and said setting unit sets differing reference positions for said first position and said second position of said seat unit.

13. A training apparatus that applies a first load to a moving unit, which is provided for the purpose of exercise, by using an electrical load generator, comprising:

a moving unit monitoring unit that monitors the movement of said moving unit when said moving unit is moving, said moving unit is movable in a first direction and a second direction which is the reverse direction of said first direction, said moving unit monitoring unit further monitors the direction of motion of said moving unit; and a load adjusting unit that changes the load from said first load to a second load if a prescribed state is detected in the movement of said moving unit by said moving unit monitoring unit, and if said load adjusting unit changes the load from said first load to said second load when said moving unit is moving in one direction, then said load adjusting unit will set the load to a third load when said moving unit monitoring unit detects that the direction of motion of said moving unit has switched to another direction, said load adjusting unit maintaining said second load until said moving unit monitoring unit detects that the direction of motion of said moving unit has been switched, and when said moving unit monitoring unit detects that the direction of motion of said moving unit has been switched, said load adjusting unit will adjust said third load to a range that is less than said first load and greater than or equal to said second load.

14. A training apparatus that applies a first load to a moving unit, which is provided for the purpose of exercise, by using an electrical load generator, comprising:

a moving unit monitoring unit that monitors the movement of said moving unit when said moving unit is moving;

a load adjusting unit that changes the load from said first load to a second load if a prescribed state is detected in the movement of said moving unit by said moving unit monitoring unit, a display unit; and an indicating unit that outputs to said display unit an indication related to the timing at which said moving unit is being moved, wherein if said load adjusting unit reduces the load from the first load to the second load when said movable unit is stopped, and then said moving unit starts to move again, said indicating unit will indicate the movement of said moving unit in accordance with the reduced load.

15. A training apparatus that applies a first load to a moving unit, which is provided for the purpose of exercise, by using an electrical load generator, comprising:

a moving unit monitoring unit that monitors the movement of said moving unit when said moving unit is moving;

a load adjusting unit that changes the load from said first load to a second load if a prescribed state is detected in the movement of said moving unit by said moving unit monitoring unit;

a setting unit that sets at least one reference position in the area in which said moving unit moves; and a seat unit configured to switch between a first position and a second position, wherein said setting unit sets differing reference positions for said first position and said second position of said seat unit and if said moving unit travels beyond said reference position along a preset direction of motion of said moving unit with respect to said reference position, said moving unit will be stopped or the load applied to the exercise will be set to zero.

16. A training apparatus that reduces a load applied to a moving unit, which is provided for the purpose of exercise, by using an electrical lead generator, comprising:

a moving unit monitoring unit that monitors the movement of the moving unit; and a load adjusting unit that reduces the load applied to the moving unit by a predetermined amount when the moving unit monitoring unit detects that the moving unit has come to rest and determines whether or not the moving unit monitoring unit detects that the moving unit starts moving again;

maintains the load with the predetermined amount reduced when the moving unit monitoring unit detects that the moving unit starts moving again after the load applied thereto is reduced; and repeatedly reduces the load by the predetermined amount and determines whether or not the moving unit starts moving again until the moving unit starts moving again when the moving unit monitoring unit detects that the moving unit has come to rest after the load applied thereto is reduced.

* * * * *